US010089990B2

(12) United States Patent
Disch et al.

(10) Patent No.: US 10,089,990 B2
(45) Date of Patent: Oct. 2, 2018

(54) AUDIO OBJECT SEPARATION FROM MIXTURE SIGNAL USING OBJECT-SPECIFIC TIME/FREQUENCY RESOLUTIONS

(71) Applicant: Fraunhofer-Gesellschaft zur Foerderung der angewandten Forschung e.V., Munich (DE)

(72) Inventors: Sascha Disch, Fuerth (DE); Jouni Paulus, Erlangen (DE); Thorsten Kastner, Erlangen (DE)

(73) Assignee: Fraunhofer-Gesellschaft zur Foerderung der angewandten Forschung e.V. (DE)

( * ) Notice: Subject to any disclaimer, the term of this patent is extended or adjusted under 35 U.S.C. 154(b) by 0 days.

(21) Appl. No.: 14/939,677

(22) Filed: Nov. 12, 2015

(65) Prior Publication Data

US 2016/0064006 A1 Mar. 3, 2016

Related U.S. Application Data

(63) Continuation of application No. PCT/EP2014/059570, filed on May 9, 2014.

(30) Foreign Application Priority Data

May 13, 2013 (EP) ..... 13167484

(51) Int. Cl.
*G10L 19/008* (2013.01)
*G10L 19/025* (2013.01)
(Continued)

(52) U.S. Cl.
CPC ..... *G10L 19/008* (2013.01); *G10L 19/20* (2013.01); *G10L 25/18* (2013.01)

(58) Field of Classification Search
CPC ..... G10L 19/008; G10L 19/02; G10L 19/022; G10L 19/025; G10L 25/18
(Continued)

(56) References Cited

U.S. PATENT DOCUMENTS 7,756,713 B2 7/2010 Chong et al.
8,095,359 B2 * 1/2012 Boehm ..... G10L 19/0212 704/203
(Continued)

FOREIGN PATENT DOCUMENTS

CN 101529501 A 9/2009
CN 1 01 821 799 A 9/2010
(Continued)

OTHER PUBLICATIONS

Beack et al.; "An Efficient Time-Frequency Representation for Parametric-Based Audio Object Coding," ETRI Journal, Dec. 2011; 33(6):945-948.
(Continued)

*Primary Examiner* — Martin Lerner
(74) *Attorney, Agent, or Firm* — Haynes and Boone, LLP

(57) ABSTRACT

An audio decoder is proposed for decoding a multi-object audio signal including a downmix signal X and side information PSI. The side information includes object-specific side information $PSI_i$ for an audio object $s_i$ in a time/frequency region $R(t_R,f_R)$, and object-specific time/frequency resolution information $TFRI_i$ indicative of an object-specific time/frequency resolution $TFR_h$ of the object-specific side information for the audio object $s_i$ in the time/frequency region $R(t_R,f_R)$. The audio decoder includes an object-specific time/frequency resolution determiner 110 configured to determine the object-specific time/frequency resolution information $TFRI_i$ from the side information PSI for the audio object $s_i$. The audio decoder further includes an
(Continued)

object separator 120 configured to separate the audio object $s_i$ from the downmix signal X using the object-specific side information in accordance with the object-specific time/frequency resolution $TFRI_i$. A corresponding encoder and corresponding methods for decoding or encoding are also described.

14 Claims, 14 Drawing Sheets

(51) Int. Cl.
*G10L 25/18* (2013.01)
*G10L 19/20* (2013.01)

(58) Field of Classification Search
USPC ..... 704/200.1, 203, 205, 206, 500, 501
See application file for complete search history.

(56) References Cited

U.S. PATENT DOCUMENTS

| | | | | |
|---|---|---|---|---|
| 8,325,929 | B2 * | 12/2012 | Koppens | G10L 19/008 381/1 |
| 8,731,950 | B2 * | 5/2014 | Herre | G10L 19/008 704/200 |
| 9,734,833 | B2 * | 8/2017 | Disch | G10L 19/025 |
| 9,786,285 | B2 * | 10/2017 | Herre | G10L 19/008 |
| 2007/0067166 | A1 * | 3/2007 | Pan | G10L 19/0216 704/222 |
| 2009/0125313 | A1 | 5/2009 | Hellmuth et al. | |
| 2009/0125314 | A1 * | 5/2009 | Hellmuth | G10L 19/008 704/501 |
| 2011/0022402 | A1 | 1/2011 | Engdegard et al. | |
| 2011/0182432 | A1 | 7/2011 | Ishikawa et al. | |
| 2012/0143613 | A1 * | 6/2012 | Herre | G10L 19/008 704/500 |
| 2014/0229187 | A1 * | 8/2014 | Herre | G10L 19/008 704/500 |
| 2015/0154968 | A1 * | 6/2015 | Kastner | G10L 19/008 704/500 |
| 2015/0213806 | A1 * | 7/2015 | Disch | G10L 19/02 704/500 |
| 2015/0279377 | A1 * | 10/2015 | Disch | G10L 19/025 381/22 |
| 2015/0348559 | A1 * | 12/2015 | Kastner | G10L 19/008 704/500 |

FOREIGN PATENT DOCUMENTS

| | | | |
|---|---|---|---|
| CN | 1 021 71 754 | A | 8/2011 |
| CN | 102177426 | A | 9/2011 |
| EP | 2015293 | A1 | 1/2009 |
| JP | 2011501544 | A | 1/2011 |
| JP | 2012-525600 | A | 10/2012 |
| KR | 1020120004547 | A | 3/2012 |
| RU | 2396608 | C2 | 8/2010 |
| RU | 2431940 | C2 | 11/2010 |
| RU | 2473062 | C2 | 1/2013 |
| WO | 2009049895 | A1 | 4/2009 |
| WO | WO2010040522 | A2 | 4/2010 |
| WO | WO2011/013381 | A1 | 2/2011 |
| WO | WO2011/039195 | A1 | 4/2011 |
| WO | WO2011061174 | | 5/2011 |
| WO | WO2011/086060 | | 7/2011 |
| WO | WO2011102967 | | 8/2011 |
| WO | 2014184115 | A1 | 11/2014 |

OTHER PUBLICATIONS

Endegard et al.; "Spatial Audio Object Coding (SAOC)—The Upcoming MPEG Standard on Parametric Object Based Audio Coding," 124th AES Convention, May 17-20, 2008; pp. 1-15; Amsterdam, The Netherlands.
Faller et al.; "Binaural Cue Coding—Part II: Schemes and Applications," IEEE Transactions on Speech and Audio Processing, Nov. 2003; 11(6):520-531.
Faller, Christof; "Parametric Joint-Coding of Audio Sources," 120th AES Convention, May 20-23, 2006; pp. 1-12; Paris, France.
Girin et al.; "Informed Audio Source Separation from Compressed Linear Stereo Mixtures," AES 42nd International Conference: Semantic Audio, 2011.
Herre et al.; "From SAC to SAOC—Recent Developments in Parametric Coding of Spatial Audio," Illusions in Sound: 22nd Regional UK AES Conference, Apr. 2007; pp. 12-1-12-8; Cambridge, United Kingdom.
ISO/IEC; "Information technology—MPEG audio technologies—Part 1: MPEG Surround," ISO/IED FDIS 23003-1:2006(E).
ISO/IEC; "Information technology—MPEG audio technologies—Part 2: Spatial Audio Object Coding (SAOC)," ISO/IEC 23003-2:2010(E).
International Search Report in related PCT Application No. PCT/EP2014/059570 dated Jul. 1, 2014, 5 pages.
Koo et al.; "Variable Subband Analysis for High Quality Spatial Audio Object Coding," IEEE 10th International Conference on Advanced Communication Technology, Feb. 17, 2008; pp. 1205-1208; Piscataway, New Jersey.
Liutkus et al.; "Informed source separation through spectrogram coding and data embedding," Signal Processing Journal, Jul. 18, 2011; 92(8):1937-1949.
Ozerov et al.; "Informed Source Separation: Source Coding Meets Source Separation," IEEE Workshop on Applications of Signal Processing to Audio and Acoustics, Oct. 16-19, 2011; 4 pages; New Paltz, New York.
Parvaix et al.; "A Watermarking-Based Method for Informed Source Separation of Audio Signals With a Single Sensor," IEEE Transactions on Audio, Speech, and Language Processing, Aug. 2010; 18(6)1464-1475.
Parvaix et al.; "Informed Source Separation of Underdetermined Instantaneous Stereo Mixtures Using Source Index Embedding," IEEE, ICASSP 2010; pp. 245-248.
Zhang et al.; "An Informed Source Separation System for Speech Signals," 12th Annual Conference of the International Speech Communication Association (Interspeech 2011), Aug. 2011; pp. 573-576; Florence, Italy.
Office action issued in parallel Japanese patent application No. 2016-513308 dated Jan. 31, 2017 (8 pages).
Notice of Decision for Patent issued in co-pending Korean Patent App. No. 10-2015-7035229 dated Jul. 25, 2017, with English translation.
Decision to Grant a Patent issued in parallel Japanese Patent App. No. 2016-513308 dated Dec. 22, 2017 (5 pages).
Decision to Grant a Patent issued in parallel Russian Patent App. No. 2015153218 dated Jan. 9, 2018 (27 pages).
Office Action and Search Report dated Jul. 30, 2018 issued in the parallel Chinese patent application No. 201480027540.7 (21 pages with English translation).

* cited by examiner

--Prior Art--

AUDIO OBJECT SEPARATION FROM MIXTURE SIGNAL USING OBJECT-SPECIFIC TIME/FREQUENCY RESOLUTIONS

CROSS-REFERENCE TO RELATED APPLICATIONS

This application is a continuation of copending International Application No. PCT/EP2014/059570, filed May 9, 2014, which is incorporated herein by reference in its entirety, and additionally claims priority from European Application No. EP 13167484.8, filed May 13, 2013, which is also incorporated herein by reference in its entirety.

The present invention relates to audio signal processing and, in particular, to a decoder, an encoder, a system, methods and a computer program for audio object coding employing audio object adaptive individual time-frequency resolution.

Embodiments according to the invention are related to an audio decoder for decoding a multi-object audio signal consisting of a downmix signal and an object-related parametric side information (PSI). Further embodiments according to the invention are related to an audio decoder for providing an upmix signal representation in dependence on a downmix signal representation and an object-related PSI. Further embodiments of the invention are related to a method for decoding a multi-object audio signal consisting of a downmix signal and a related PSI. Further embodiments according to the invention are related to a method for providing an upmix signal representation in dependence on a downmix signal representation and an object-related PSI.

Further embodiments of the invention are related to an audio encoder for encoding a plurality of audio object signals into a downmix signal and a PSI. Further embodiments of the invention are related to a method for encoding a plurality of audio object signals into a downmix signal and a PSI.

Further embodiments according to the invention are related to a computer program corresponding to the method(s) for decoding, encoding, and/or providing an upmix signal.

Further embodiments of the invention are related to audio object adaptive individual time-frequency resolution switching for signal mixture manipulation.

BACKGROUND OF THE INVENTION

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bitrate efficient way. Therefore, one is willing to accept a reasonable tradeoff between audio quality and bitrate requirements in order to avoid an excessive resource load caused by multi-channel/multi-object applications.

Recently, in the field of audio coding, parametric techniques for the bitrate-efficient transmission/storage of multi-channel/multi-object audio signals have been introduced by, e.g., the Moving Picture Experts Group (MPEG) and others. One example is MPEG Surround [ISO/IEC 23003-1:2007, MPEG-D (MPEG audio technologies), Part 1: MPEG Surround, 2007] as a channel oriented approach [ISO/IEC 23003-1:2007, MPEG-D (MPEG audio technologies), Part 1: MPEG Surround, 2007, and C. Faller and F. Baumgarte, "Binaural Cue Coding—Part II: Schemes and applications," *IEEE Trans. on Speech and Audio Proc.*, vol. 11, no. 6, November 2003], or MPEG Spatial Audio Object Coding (SAOC) as an object oriented approach [C. Faller, "Parametric Joint-Coding of Audio Sources," 120*th AES Convention*, Paris, 2006; ISO/IEC, "MPEG audio technologies—Part 2: Spatial Audio Object Coding (SAOC)", ISO/IEC JTC1/SC29/WG11 (MPEG) International Standard 23003-2; J. Herre, S. Disch, J. Hilpert, O. Hellmuth: "From SAC To SAOC—Recent Developments in Parametric Coding of Spatial Audio," 22*nd Regional UK AES Conference*, Cambridge, UK, April 2007; J. Engdegård, B. Resch, C. Falch, O. Hellmuth, J. Hilpert, A. Holzer, L. Terentiev, J. Breebaart, J. Koppens, E. Schuijers and W. Oomen: "Spatial Audio Object Coding (SAOC)—The Upcoming MPEG Standard on Parametric Object Based Audio Coding," 124*th AES Convention*, Amsterdam 2008]. Another object-oriented approach is termed as "informed source separation" [M. Parvaix and L. Girin: "Informed Source Separation of underdetermined instantaneous Stereo Mixtures using Source Index Embedding," *IEEE ICASSP,* 2010; M. Parvaix, L. Girin, J.-M. Brassier: "A watermarking-based method for informed source separation of audio signals with a single sensor," *IEEE Transactions on Audio, Speech and Language Processing,* 2010; A. Liutkus and J. Pinel and R. Badeau and L. Girin and G. Richard: "Informed source separation through spectrogram coding and data embedding," Signal Processing Journal, 2011; A. Ozerov, A. Liutkus, R. Badeau, G. Richard: "Informed source separation: source coding meets source separation," *IEEE Workshop on Applications of Signal Processing to Audio and Acoustics,* 2011; Shuhua Zhang and Laurent Girin: "An Informed Source Separation System for Speech Signals," *INTERSPEECH,* 2011; L. Girin and J. Pinel: "Informed Audio Source Separation from Compressed Linear Stereo Mixtures," AES 42*nd International Conference: Semantic Audio,* 2011]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 1, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (Side Information Estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 1. The desired target scene may be, in the extreme case, the rendering of only one source signal out of the mixture (source separation scenario), but also any other arbitrary acoustic scene consisting of the objects transmitted.

Time-frequency based systems may utilize a time-frequency (t/f) transform with static temporal and frequency resolution. Choosing a certain fixed t/f-resolution grid typically involves a trade-off between time and frequency resolution.

The effect of a fixed t/f-resolution can be demonstrated on the example of typical object signals in an audio signal mixture. For example, the spectra of tonal sounds exhibit a harmonically related structure with a fundamental frequency and several overtones. The energy of such signals is concentrated at certain frequency regions. For such signals, a high frequency resolution of the utilized t/f-representation is beneficial for separating the narrowband tonal spectral regions from a signal mixture. In the contrary, transient signals, like drum sounds, often have a distinct temporal structure: substantial energy is only present for short periods of time and is spread over a wide range of frequencies. For these signals, a high temporal resolution of the utilized t/f-representation is advantageous for separating the transient signal portion from the signal mixture.

It would be desirable to take into account the different needs of different types of audio objects regarding their representation in the time-frequency domain when generating and/or evaluating object-specific side information at the encoder side or at the decoder side, respectively.

SUMMARY

According to an embodiment, an audio decoder for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have: an object-specific time/frequency resolution determiner configured to determine the object-specific time/frequency resolution information from the side information for the at least one audio object; and an object separator configured to separate the at least one audio object from the downmix signal using the object-specific side information in accordance with the object-specific time/frequency resolution.

According to another embodiment, an audio encoder for encoding a plurality of audio objects into a downmix signal and side information may have: a time-to-frequency transformer configured to transform the plurality of audio objects at least to a first plurality of corresponding transformations using a first time/frequency resolution and to a second plurality of corresponding transformations using a second time/frequency resolution; a side information determiner configured to determine at least a first side information for the first plurality of corresponding transformations and a second side information for the second plurality of corresponding transformations, the first and second side information indicating a relation of the plurality of audio objects to each other in the first and second time/frequency resolutions, respectively, in a time/frequency region; and a side information selector configured to select, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder.

According to another embodiment, a method for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have the steps of: determining the object-specific time/frequency resolution information from the side information for the at least one audio object; and separating the at least one audio object from the downmix signal using the object-specific side information in accordance with the object-specific time/frequency resolution.

According to another embodiment, a method for encoding a plurality of audio object to a downmix signal and side information may have the steps of: transforming the plurality of audio object at least to a first plurality of corresponding transformations using a first time/frequency resolution and to a second plurality of corresponding transformations using a second time/frequency resolution; determining at least a first side information for the first plurality of corresponding transformations and a second side information for the second plurality of corresponding transformations, the first and second side information indicating a relation of the plurality of audio object to each other in the first and second time/frequency resolutions, respectively, in a time/frequency region; and selecting, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder.

According to another embodiment, an audio decoder for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have: an object-specific time/frequency resolution determiner configured to determine the object-specific time/frequency resolution information from the side information for the at least one audio object; and an object separator configured to separate the at least one audio object from the downmix signal using the object-specific side information in accordance with the object-specific time/frequency resolution, wherein object-specific side information for at least one other audio object within the downmix signal has a different object-specific time/frequency resolution.

According to another embodiment, a method for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have the steps of: determining the object-specific time/frequency resolution information from the side information for the at least one audio object; and separating the at least one audio object from the downmix signal using the object-specific side information in accordance with the object-specific time/frequency resolution, wherein object-specific side information for at least one other audio object within the downmix signal has a different object-specific time/frequency resolution.

Another embodiment may have a computer program for performing any of the methods when the computer program runs on a computer.

According to another embodiment, an audio decoder for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have: an object-specific time/frequency resolution determiner configured to determine the object-specific time/frequency resolution information from the side information for the at least one audio object; and an object separator configured to separate the at least one audio object from the downmix signal using the object-specific side information in accordance with the object-specific time/frequency resolution, wherein the object-specific side information is a fine structure object-specific side information for the at least one audio object in the at least one time/frequency region, and wherein the side information further includes coarse object-specific side information for the at least one audio object in the at least one time/frequency region, the coarse object-specific side information being constant within the at least one time/frequency region, or wherein the fine structure object-specific side information describes a difference between the coarse object-specific side information and the at least one audio object.

According to another embodiment, a method for decoding a multi-object audio signal including a downmix signal and side information, the side information including object-specific side information for at least one audio object in at least one time/frequency region, and object-specific time/frequency resolution information indicative of an object-specific time/frequency resolution of the object-specific side information for the at least one audio object in the at least one time/frequency region, may have the steps of: determining the object-specific time/frequency resolution information from the side information for the at least one audio object; and separating the at least one audio object from the downmix signal using the object-specific side information in accordance with the object-specific time/frequency resolution, wherein the object-specific side information is a fine structure object-specific side information for the at least one audio object in the at least one time/frequency region, and wherein the side information further includes coarse object-specific side information for the at least one audio object in the at least one time/frequency region, the coarse object-specific side information being constant within the at least one time/frequency region, or wherein the fine structure object-specific side information describes a difference between the coarse object-specific side information and the at least one audio object.

According to at least some embodiments, an audio decoder for decoding a multi-object signal is provided. The multi-object audio signal consists of a downmix signal and side information. The side information comprises object-specific side information for at least one audio object in at least one time/frequency region. The side information further comprises object-specific time/frequency resolution information indicative of an object-specific time/frequency resolution of the object-specific side information for the at least one audio object in the at least one time/frequency region. The audio decoder comprises an object-specific time/frequency resolution determiner configured to determine the object-specific time/frequency resolution information from the side information for the at least one audio object. The audio decoder further comprises an object separator configured to separate the at least one audio object from the downmix signal using the object-specific side information in accordance with the object-specific time/frequency resolution.

Further embodiments provide an audio encoder for encoding a plurality of audio objects into a downmix signal and side information. The audio encoder comprises a time-to-frequency transformer configured to transform the plurality of audio objects at least to a first plurality of corresponding transformations using a first time/frequency resolution and to a second plurality of corresponding transformations using a second time/frequency resolution. The audio encoder further comprises a side information determiner configured to determine at least a first side information for the first plurality of corresponding transformations and a second side information for the second plurality of corresponding transformations. The first and second side information indicate a relation of the plurality of audio objects to each other in the first and second time/frequency resolutions, respectively, in a time/frequency region. The audio encoder also comprises a side information selector configured to select, for at least one audio object of the plurality of audio objects, one object-specific side information from at least the first and second side information on the basis of a suitability criterion. The suitability criterion is indicative of a suitability of at least the first or second time/frequency resolution for representing the audio object in the time/frequency domain. The selected object-specific side information is inserted into the side information output by the audio encoder.

Further embodiments of the present invention provide a method for decoding a multi-object audio signal consisting of a downmix signal and side information. The side information comprises object-specific side information for at least one audio object in at least one time/frequency region, and object-specific time/frequency resolution information indicative of an object-specific time/frequency resolution of the object-specific side information for the at least one audio object in the at least one time/frequency region. The method comprises determining the object-specific time/frequency resolution information from the side information for the at least one audio object. The method further comprises separating the at least one audio object from the downmix signal using the object-specific side information in accordance with the object-specific time/frequency resolution.

Further embodiments of the present invention provide a method for encoding a plurality of audio objects to a downmix signal and side information. The method comprises transforming the plurality of audio object at least to a first plurality of corresponding transformations using a first time/frequency resolution and to a second plurality of corresponding transformations using a second time/frequency resolution. The method further comprises determining at least a first side information for the first plurality of corresponding transformations and a second side information for the second plurality of corresponding transformations. The first and second side information indicate a relation of the plurality of audio objects to each other in the first and second time/frequency resolutions, respectively, in a time/frequency region. The method further comprises selecting, for at least one audio object of the plurality of audio objects, one object-specific side information from at least the first and second side information on the basis of a suitability criterion. The suitability criterion is indicative of a suitability of at least the first or second time/frequency resolution for representing the audio object in the time/frequency domain. The object-specific side information is inserted into the side information output by the audio encoder.

The performance of audio object separation typically decreases if the utilized t/f-representation does not match with the temporal and/or spectral characteristics of the audio object to be separated from the mixture. Insufficient performance may lead to crosstalk between the separated objects. Said crosstalk is perceived as pre- or post-echoes, timbre modifications, or, in the case of human voice, as so-called double-talk. Embodiments of the invention offer several alternative t/f-representations from which the most suited t/f-representation can be selected for a given audio object and a given time/frequency region when determining the side information at an encoder side, or when using the side information at a decoder side. This provides improved separation performance for the separation of the audio objects and an improved subjective quality of the rendered output signal compared to the state of the art.

Compared to other schemes for encoding/decoding spatial audio objects, the amount of side information may be substantially the same or slightly higher. According to embodiments of the invention, the side information is used in an efficient manner, as it is applied in an object-specific way taking into account the object-specific properties of a given audio object regarding its temporal and spectral structure. In other words, the t/f-representation of the side information is tailored to the various audio objects.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
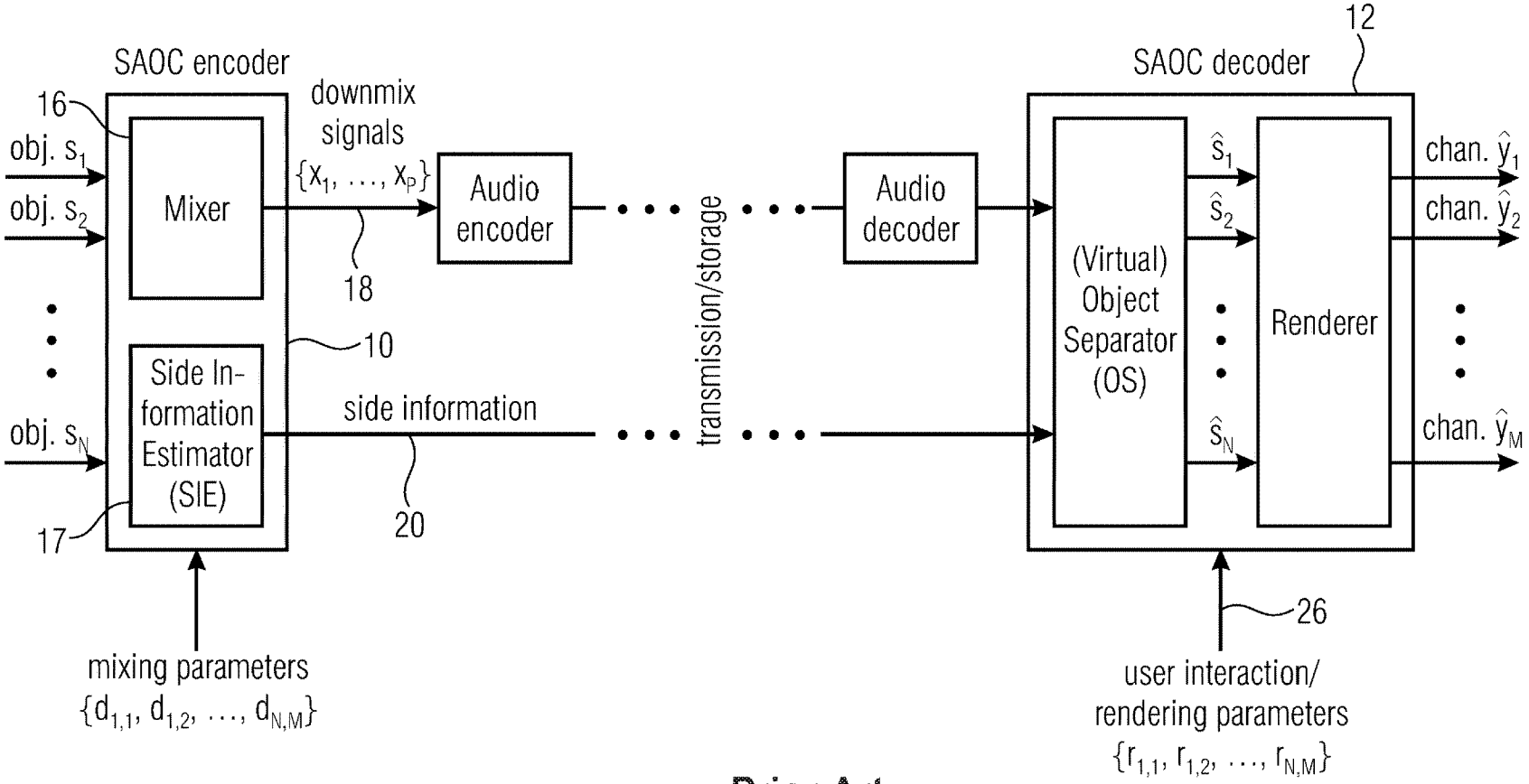
FIG. 1 shows a schematic block diagram of a conceptual overview of an SAOC system.

FIG. 1 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 1, the downmix signal is shown to be a P-channel signal. Thus, any mono (P=1), stereo (P=2) or multi-channel (P>=2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_1$ to $s_N$, side information estimator 17 provides the SAOC decoder 12 with side information including SAOC-parameters. For example, in case of a stereo downmix, the SAOC parameters comprise object level differences (OLD), inter-object cross correlation parameters (IOC), downmix gain values (DMG) and downmix channel level differences (DCLD). The side information 20 including the SAOC-parameters, along with the downmix signal 18, forms the SAOC output data stream received by the SAOC decoder 12.

The SAOC decoder 12 comprises an upmixer which receives the downmix signal 18 as well as the side information 20 in order to recover and render the audio signals $s_1$ and $s_N$ onto any user-selected set of channels $\hat{y}_1$ to $\hat{y}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

Figure 2:
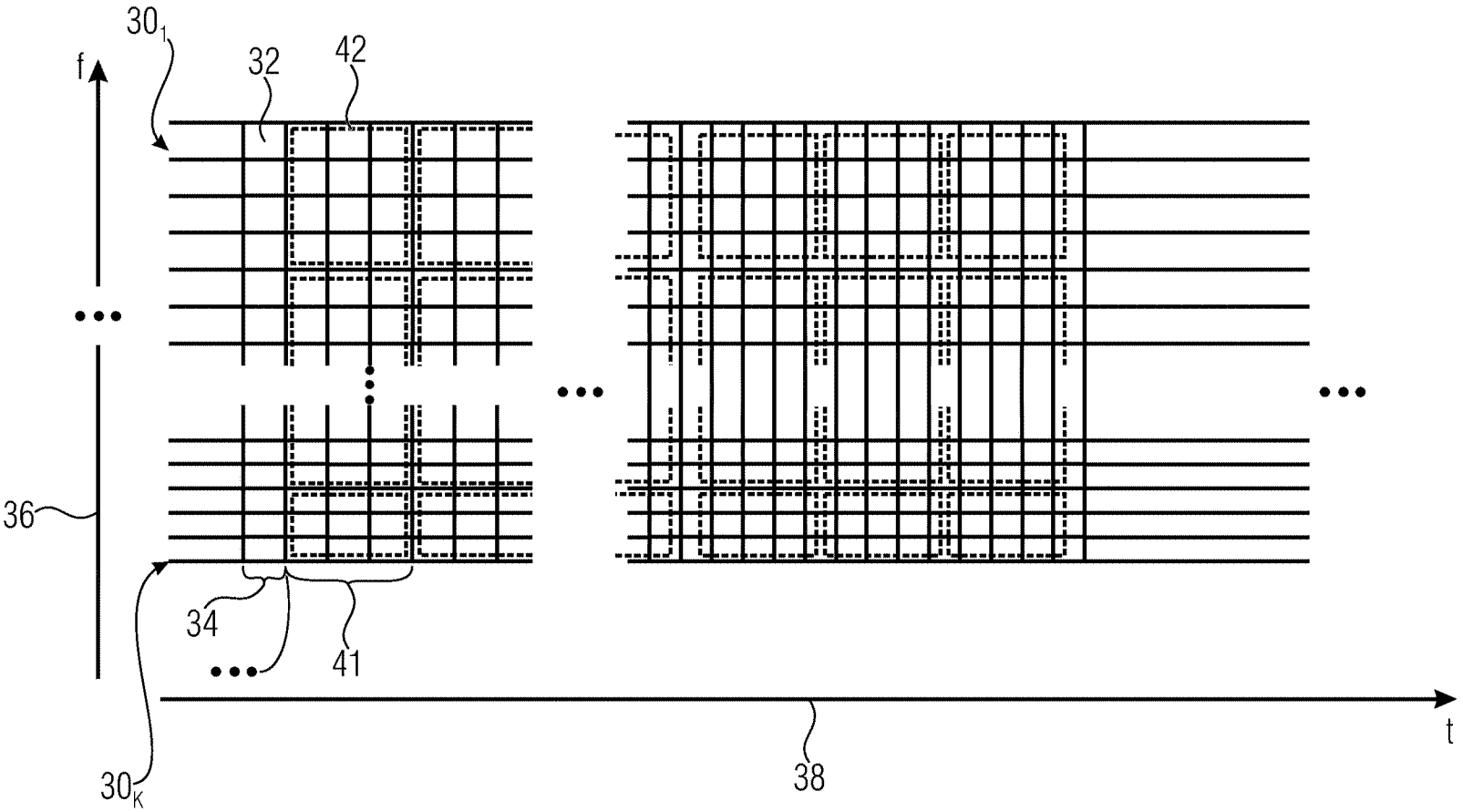
FIG. 2 shows a schematic and illustrative diagram of a temporal-spectral representation of a single-channel audio signal.

FIG. 2 shows an audio signal in the just-mentioned spectral domain. As can be seen, the audio signal is represented as a plurality of sub-band signals. Each sub-band signal $\mathbf{30}_1$ to $\mathbf{30}_K$ consists of a sequence of sub-band values indicated by the small boxes 32. As can be seen, the sub-band values 32 of the sub-band signals $\mathbf{30}_1$ to $\mathbf{30}_K$ are synchronized to each other in time so that for each of consecutive filter bank time slots 34 each sub-band $\mathbf{30}_1$ to $\mathbf{30}_K$ comprises exactly one sub-band value 32. As illustrated by the frequency axis 36, the sub-band signals $\mathbf{30}_1$ to $\mathbf{30}_K$ are associated with different frequency regions, and as illustrated by the time axis 38, the filter bank time slots 34 are consecutively arranged in time.

As outlined above, side information extractor 17 computes SAOC-parameters from the input audio signals $s_1$ to $s_N$. According to the currently implemented SAOC standard, encoder 10 performs this computation in a time/frequency resolution which may be decreased relative to the original time/frequency resolution as determined by the filter bank time slots 34 and sub-band decomposition, by a certain amount, with this certain amount being signaled to the decoder side within the side information 20. Groups of consecutive filter bank time slots 34 may form a SAOC frame 41. Also the number of parameter bands within the SAOC frame 41 is conveyed within the side information 20. Hence, the time/frequency domain is divided into time/frequency tiles exemplified in FIG. 2 by dashed lines 42. In FIG. 2 the parameter bands are distributed in the same manner in the various depicted SAOC frames 41 so that a regular arrangement of time/frequency tiles is obtained. In general, however, the parameter bands may vary from one SAOC frame 41 to the subsequent, depending on the different needs for spectral resolution in the respective SAOC frames 41. Furthermore, the length of the SAOC frames 41 may vary, as well. As a consequence, the arrangement of time/frequency tiles may be irregular. Nevertheless, the time/frequency tiles within a particular SAOC frame 41 typically have the same duration and are aligned in the time direction, i.e., all t/f-tiles in said SAOC frame 41 start at the start of the given SAOC frame 41 and end at the end of said SAOC frame 41.

The side information extractor 17 calculates SAOC parameters according to the following formulas. In particular, side information extractor 17 computes object level differences for each object i as $$OLD_i^{l,m} = \frac{\sum_{n\in l}\sum_{k\in m} x_i^{n,k} x_i^{n,k*}}{\max_j\left(\sum_{n\in l}\sum_{k\in m} x_j^{n,k} x_j^{n,k*}\right)}$$

wherein the sums and the indices n and k, respectively, go through all temporal indices 34, and all spectral indices 30 which belong to a certain time/frequency tile 42, referenced by the indices l for the SAOC frame (or processing time slot) and in for the parameter band. Thereby, the energies of all sub-band values $x_i$ of an audio signal or object i are summed up and normalized to the highest energy value of that tile among all objects or audio signals.

Further the SAOC side information extractor 17 is able to compute a similarity measure of the corresponding time/frequency tiles of pairs of different input objects $s_1$ to $s_N$. Although the SAOC downmixer 16 may compute the similarity measure between all the pairs of input objects $s_1$ to $s_N$, downmixer 16 may also suppress the signaling of the similarity measures or restrict the computation of the similarity measures to audio objects $s_1$ to $s_N$ which form left or right channels of a common stereo channel. In any case, the similarity measure is called the inter-object cross-correlation parameter $IOC_{i,j}^{l,m}$. The computation is as follows $$IOC_{i,j}^{l,m} = IOC_{j,i}^{l,m} = \mathrm{Re}\left\{\frac{\sum_{n\in l}\sum_{k\in m} x_i^{n,k} x_j^{n,k*}}{\sqrt{\sum_{n\in l}\sum_{k\in m} x_i^{n,k} x_i^{n,k*} \sum_{n\in l}\sum_{k\in m} x_j^{n,k} x_j^{n,k*}}}\right\}$$

with again indices n and k going through all sub-band values belonging to a certain time/frequency tile 42, and i and j denoting a certain pair of audio objects $s_1$ to $s_N$.

The downmixer 16 downmixes the objects $s_1$ to $s_N$ by use of gain factors applied to each object $s_1$ to $s_N$. That is, a gain factor $D_i$ is applied to object i and then all thus weighted objects $s_1$ to $s_N$ are summed up to obtain a mono downmix signal, which is exemplified in FIG. 1 if P=1. In another example case of a two-channel downmix signal, depicted in FIG. 1 if P=2, a gain factor $D_{1,i}$ is applied to object i and then all such gain amplified objects are summed in order to obtain the left downmix channel L0, and gain factors $D_{2,i}$ are applied to object i and then the thus gain-amplified objects are summed in order to obtain the right downmix channel R0. A processing that is analogous to the above is to be applied in case of a multi-channel downmix (P>=2).

This downmix prescription is signaled to the decoder side by means of down mix gains $DMG_i$ and, in case of a stereo downmix signal, downmix channel level differences $DCLD_i$.

The downmix gains are calculated according to:

$$DMG_i=20\log_{10}(D_i+\varepsilon),\ \text{(mono downmix)},$$

$$DMG_i=10\log_{10}(D_{1,i}^2+D_{2,i}^2+\varepsilon),\ \text{(stereo downmix)},$$

where ε is a small number such as $10^{-9}$.

For the $DCLD_S$ the following formula applies:

$$DCLD_i = 20\log_{10}\left(\frac{D_{1,i}}{D_{2,i}+\varepsilon}\right).$$

In the normal mode, downmixer 16 generates the downmix signal according to:

$$(L0) = (D_i)\begin{pmatrix} Obj_1 \\ \vdots \\ Obj_N \end{pmatrix}$$

for a mono downmix, or $$\begin{pmatrix} L0 \\ R0 \end{pmatrix} = \begin{pmatrix} D_{1,i} \\ D_{2,i} \end{pmatrix}\begin{pmatrix} Obj_1 \\ \vdots \\ Obj_N \end{pmatrix}$$

for a stereo downmix, respectively.

Thus, in the abovementioned formulas, parameters OLD and IOC are a function of the audio signals and parameters DMG and DCLD are a function of D. By the way, it is noted that D may be varying in time.

Thus, in the normal mode, downmixer 16 mixes all objects $s_1$ to $s_N$ with no preferences, i.e., with handling all objects $s_1$ to $s_N$ equally.

At the decoder side, the upmixer performs the inversion of the downmix procedure and the implementation of the "rendering information" 26 represented by a matrix R (in the literature sometimes also called A) in one computation step, namely, in case of a two-channel downmix $$\begin{pmatrix} Ch_1 \\ \vdots \\ Ch_M \end{pmatrix} = RED^*(DED^*)^{-1}\begin{pmatrix} L0 \\ R0 \end{pmatrix},$$

where matrix E is a function of the parameters OLD and IOC. The matrix E is an estimated covariance matrix of the audio objects $s_1$ to $s_N$. In current SAOC implementations, the computation of the estimated covariance matrix E is typically performed in the spectral/temporal resolution of the SAOC parameters, i.e., for each (l,m), so that the estimated covariance matrix may be written as $E^{l,m}$. The estimated covariance matrix $E_{l,m}$ is of size N×N with its coefficients being defined as $$e_{i,j}^{l,m}=\sqrt{OLD_i^{l,m}OLD_j^{l,m}}IOC_{i,j}^{l,m}.$$

Thus, the matrix $E^{l,m}$ with $$E^{l,m} = \begin{pmatrix} e_{1,1}^{l,m} & \cdots & e_{1,N}^{l,m} \\ \vdots & \ddots & \vdots \\ e_{N,1}^{l,m} & \cdots & e_{N,N}^{l,m} \end{pmatrix}$$

has along its diagonal the object level differences, i.e., $e_{i,j}^{l,m}=OLD_i^{l,m}$ for i=j, since $OLD_i^{l,m}=OLD_j^{l,m}$ and $IOC_{i,j}^{l,m}=1$ for i=j. Outside its diagonal the estimated covariance matrix E has matrix coefficients representing the geometric mean of the object level differences of objects i and j, respectively, weighted with the inter-object cross correlation measure $IOC_{i,j}^{l,m}$.

Figure 3:
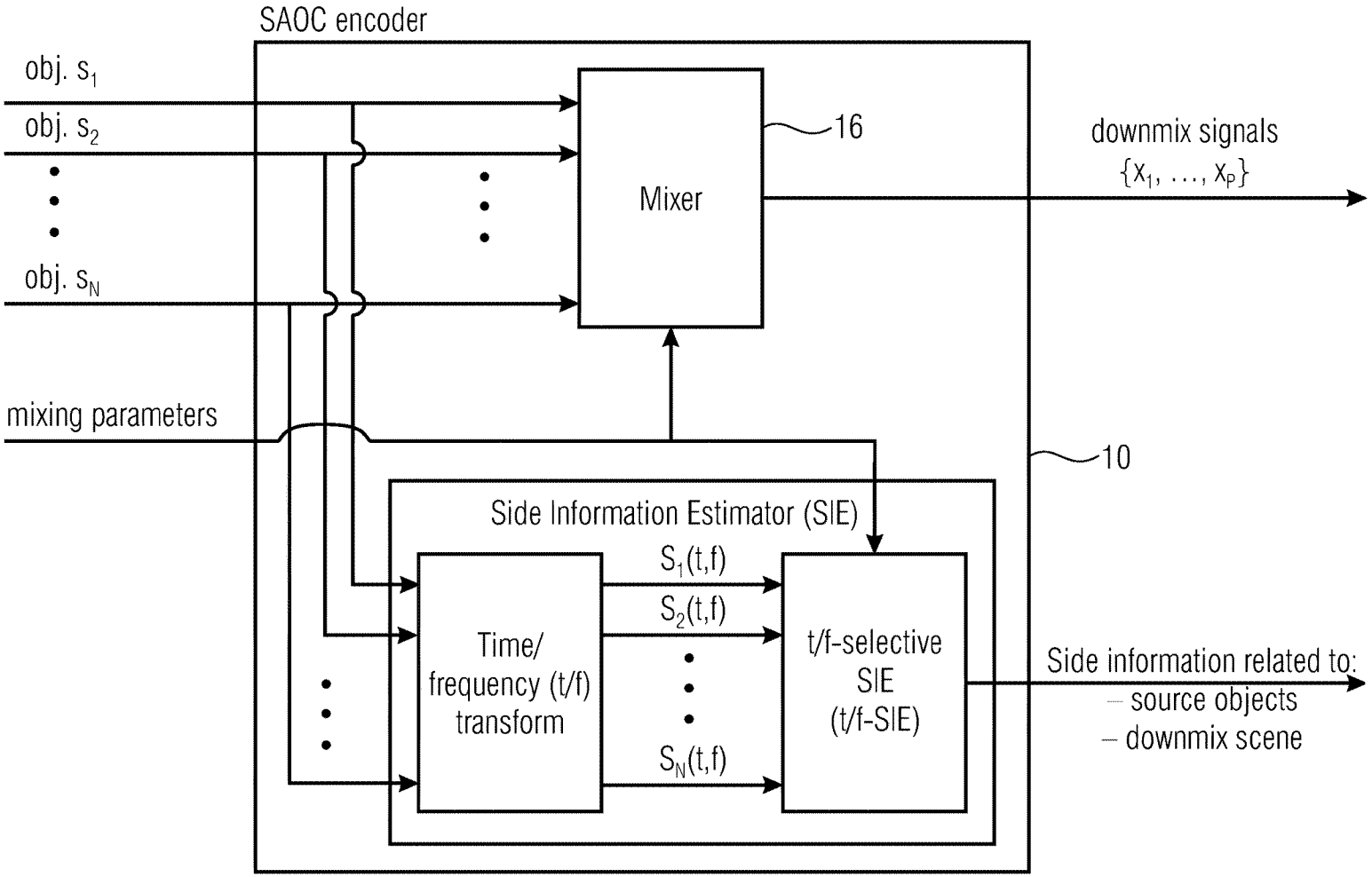
FIG. 3 shows a schematic block diagram of a time-frequency selective computation of side information within an SAOC encoder.

FIG. 3 displays one possible principle of implementation on the example of the Side Information Estimator (SIE) as part of a SAOC encoder 10. The SAOC encoder 10 comprises the mixer 16 and the Side Information Estimator SIE. The SIE conceptually consists of two modules: One module to compute a short-time based t/f-representation (e.g., STFT or QMF) of each signal. The computed short-time t/f-representation is fed into the second module, the t/f-selective Side Information Estimation module (t/f-SIE). The t/f-SIE computes the side information for each t/f-tile. In current SAOC implementations, the time/frequency transform is fixed and identical for all audio objects $s_1$ to $s_N$. Furthermore, the SAOC parameters are determined over SAOC frames which are the same for all audio objects and have the same time/frequency resolution for all audio objects $s_1$ to $s_N$, thus disregarding the object-specific needs for fine temporal resolution in some cases or fine spectral resolution in other cases.

Some limitations of the current SAOC concept are described now: In order to keep the amount of data associated with the side information relatively small, the side information for the different audio objects is determined in an advantageously coarse manner for time/frequency regions that span several time-slots and several (hybrid) sub-bands of the input signals corresponding to the audio objects. As stated above, the separation performance observed at the decoder side might be sub-optimal if the utilized t/f-representation is not adapted to the temporal or spectral characteristics of the object signal to be separated from the mixture signal (downmix signal) in each processing block (i.e., t/f region or t/f-tile). The side information for tonal parts of an audio object and transient parts of an audio object are determined and applied on the same time/frequency tiling, regardless of current object characteristics. This typically leads to the side information for the primarily tonal audio object parts being determined at a spectral resolution that is somewhat too coarse, and also the side information for the primarily transient audio object parts being determined at a temporal resolution that is somewhat too coarse. Similarly, applying this non-adapted side information in a decoder leads to sub-optimal object separation results that are impaired by object crosstalk in form of, e.g., spectral roughness and/or audible pre- and post-echoes.

For improving the separation performance at the decoder side, it would be desirable to enable the decoder or a corresponding method for decoding to individually adapt the t/f-representation used for processing the decoder input signals ("side information and downmix") according to the characteristics of the desired target signal to be separated. For each target signal (object) the most suitable t/f-representation is individually selected for processing and separating, for example, out of a given set of available representations. The decoder is thereby driven by side information that signals the t/f-representation to be used for each individual object at a given time span and a given spectral region. This information is computed at the encoder and conveyed in addition to the side information already transmitted within SAOC.

The invention is related to an Enhanced Side Information Estimator (E-SIE) at the encoder to compute side information enriched by information that indicates the most suitable individual t/f-representation for each of the object signals.

The invention is further related to a (virtual) Enhanced Object Separator (E-OS) at the receiving end. The E-OS exploits the additional information that signals the actual t/f-representation that is subsequently employed for the estimation of each object.

Figure 5:
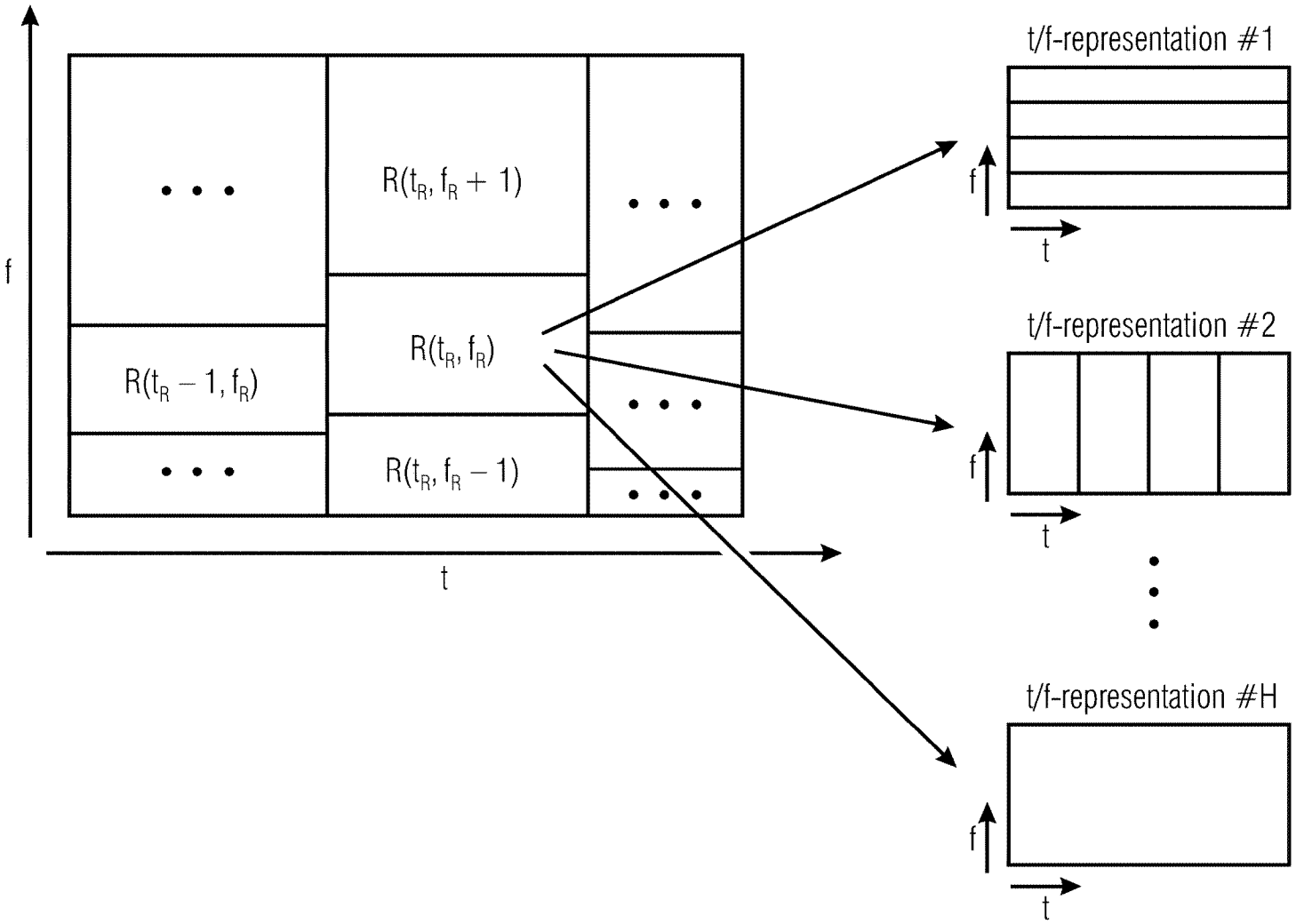
FIG. 5 schematically illustrates a t/f-region $R(t_R,f_R)$ represented by different t/f-representations.

The E-SIE may comprise two modules. One module computes for each object signal up to H t/f-representations, which differ in temporal and spectral resolution and meet the following requirement: time/frequency-regions $R(t_R,f_R)$ can be defined such that the signal content within these regions can be described by any of the H t/f-representations. FIG. 5 illustrates this concept on the example of H t/f-representations and shows a t/f-region $R(t_R,f_R)$ represented by two different t/f-representations. The signal content within t/f-region $R(t_R,f_R)$ can be represented with a high spectral resolution, but a low temporal resolution (t/f-representation #1), with a high temporal resolution, but a low spectral resolution (t/f-representation #2), or with some other combination of temporal and spectral resolutions (t/f-representation #H). The number of possible t/f-representations is not limited.

Figure 4:
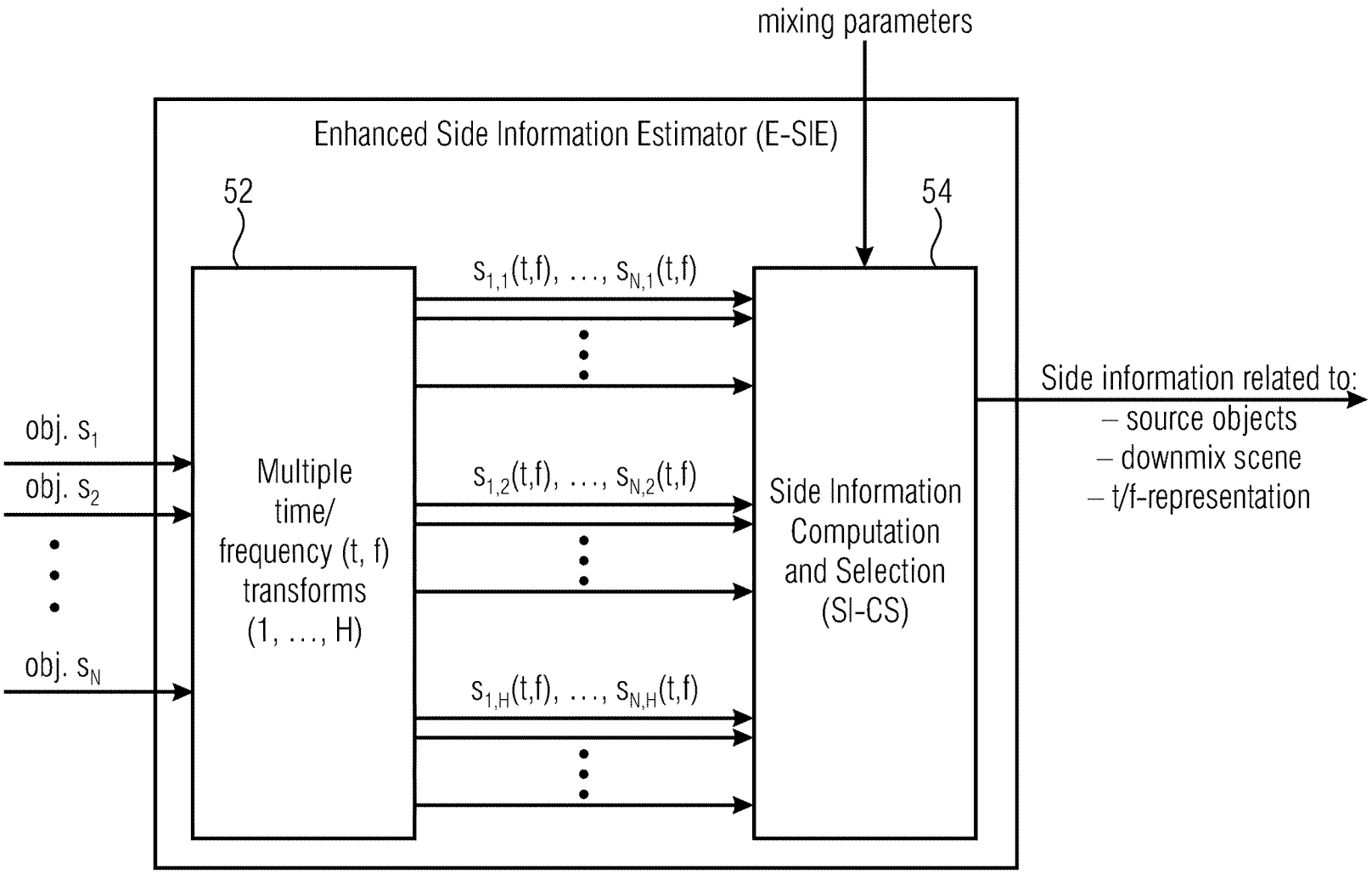
FIG. 4 schematically illustrates the principle of an enhanced side information estimator according to some embodiments.

Accordingly, an audio encoder for encoding a plurality of audio object signals $s_i$ into a downmix signal X and side information PSI is provided. The audio encoder comprises an enhanced side information estimator E-SIE schematically illustrated in FIG. 4. The enhanced side information estimator E-SIE comprises a time/-frequency transformer 52 configured to transform the plurality of audio object signals $s_i$ at least to a first plurality of corresponding transformed signals $s_{1,1}(t,f) \ldots s_{N,1}(t,f)$ using at least a first time/frequency resolution $TFR_1$ (first time/frequency discretization) and to a second plurality of corresponding transformations $s_{i,2}(t,f) \ldots s_{N,2}(t,f)$ using a second time/frequency resolution $TFR_2$ (second time/frequency discretization). In some embodiments, the time-frequency transformer 52 may be configured to use more than two time/frequency resolutions $TFR_1$ to $TFR_H$. The enhanced side information estimator (E-SIE) further comprises a side information computation and selection module (SI-CS) 54. The side information computation and selection module comprises (see FIG. 6) a side information determiner (t/f-SIE) or a plurality of side information determiners 55-1 . . . 55-H configured to determine at least a first side information for the first plurality of corresponding transformations $s_{1,1}(t,f) \ldots s_{N,1}(t,f)$ and a second side information for the second plurality of corresponding transformations $s_{1,2}(t,f) \ldots s_{N,2}(t,f)$, the first and second side information indicating a relation of the plurality of audio object signals $s_i$ to each other in the first and second time/frequency resolutions $TFR_1$, $TFR_2$, respectively, in a time/frequency region $R(t_R,f_R)$. The relation of the plurality of audio signals si to each other may, for example, relate to relative energies of the audio signals in different frequency bands and/or a degree of correlation between the audio signals. The side information computation and selection module 54 further comprises a side information selector (SI-AS) 56 configured to select, for each audio object signal $s_i$, one object-specific side information from at least the first and second side information on the basis of a suitability criterion indicative of a suitability of at least the first or second time/frequency resolution for representing the audio object signal $s_i$ in the time/frequency domain. The object-specific side information is then inserted into the side information PSI output by the audio encoder.

Note that the grouping of the t/f-plane into t/f-regions $R(t_R,f_R)$ may not necessarily be equidistantly spaced, as FIG. 5 indicates. The grouping into regions R $(t_R,f_R)$ can, for example, be non-uniform to be perceptually adapted. The grouping may also be compliant with the existing audio object coding schemes, such as SAOC, to enable a backward-compatible coding scheme with enhanced object estimation capabilities.

The adaptation of the t/f-resolution is not only limited to specifying a differing parameter-tiling for different objects, but the transform the SAOC scheme is based on (i.e., typically presented by the common time/frequency resolution used in state-of-the-art systems for SAOC processing) can also be modified to better fit the individual target objects. This is especially useful, e.g., when a higher spectral resolution than provided by the common transform the SAOC scheme is based on is needed. In the example case of MPEG SAOC, the raw resolution is limited to the (common) resolution of the (hybrid) QMF bank. By the inventive processing, it is possible to increase the spectral resolution, but as a trade-off, some of the temporal resolution is lost in the process. This is accomplished using a so-called (spectral) zoom-transform applied on the outputs of the first filterbank. Conceptually, a number of consecutive filter bank output samples are handled as a time-domain signal and a second transform is applied on them to obtain a corresponding number of spectral samples (with only one temporal slot). The zoom transform can be based on a filter bank (similar to the hybrid filter stage in the MPEG SAOC), or a block-based transform such as DFT or Complex Modified Discrete Cosine Transform (CMDCT). In a similar manner, it is also possible to increase the temporal resolution at the cost of the spectral resolution (temporal zoom transform): A number of concurrent outputs of several filters of the (hybrid) QMF bank are sampled as a frequency-domain signal and a second transform is applied to them to obtain a corresponding number of temporal samples (with only one large spectral band covering the spectral range of the several filters).

Figure 6:
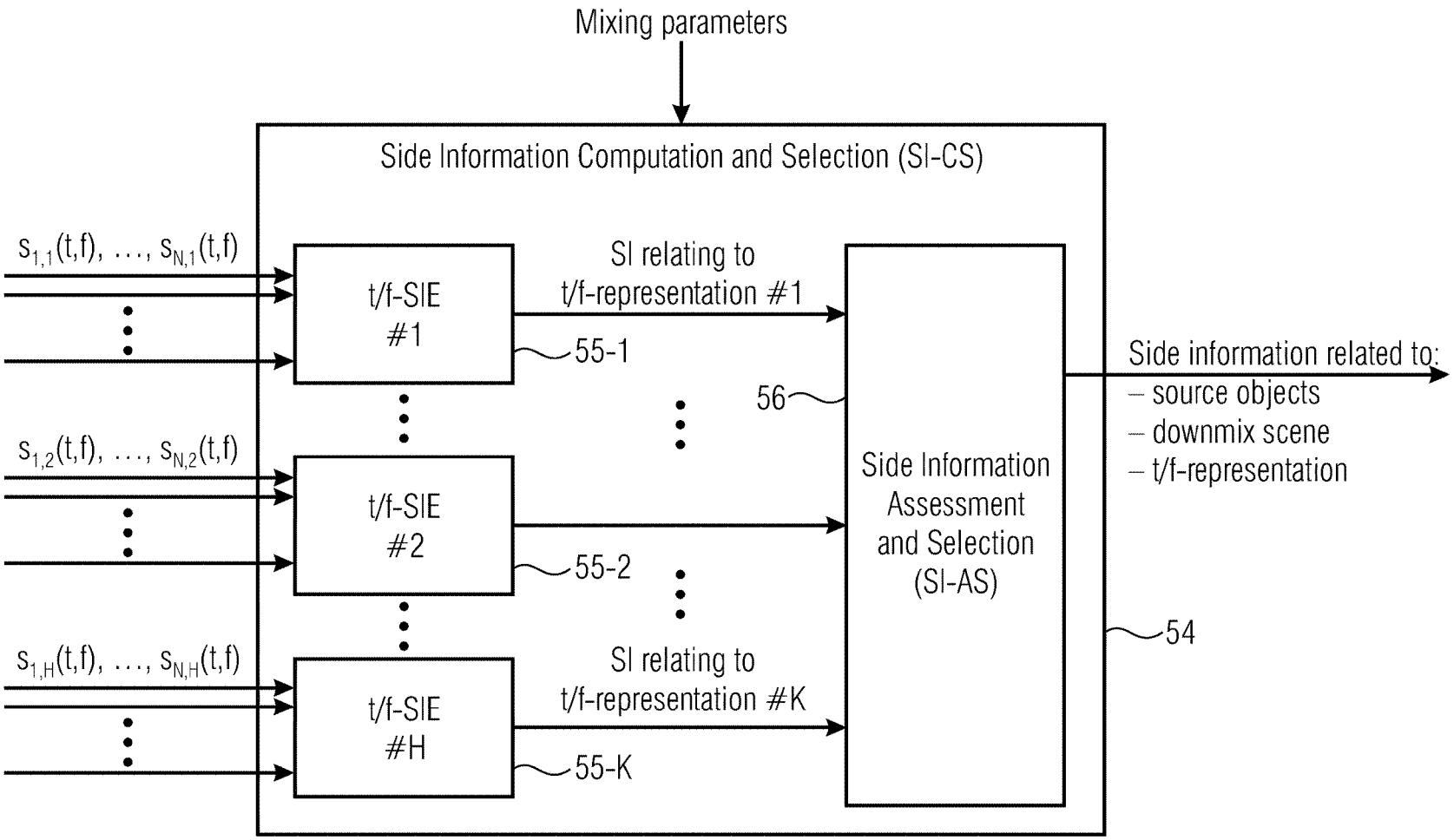
FIG. 6 is a schematic block diagram of a side information computation and selection module according to embodiments.

For each object, the H t/f-representations are fed together with the mixing parameters into the second module, the Side Information Computation and Selection module SI-CS. The SI-CS module determines, for each of the object signals, which of the H t/f-representations should be used for which t/f-region R(tR, fR) at the decoder to estimate the object signal. FIG. 6 details the principle of the SI-CS module.

For each of the H different t/f-representations, the corresponding side information (SI) is computed. For example, the t/f-SIE module within SAOC can be utilized. The computed H side information data are fed into the Side Information Assessment and Selection module (SI-AS). For each object signal, the SI-AS module determines the most appropriate t/f-representation for each t/f-region for estimating the object signal from the signal mixture.

Besides the usual mixing scene parameters, the SI-AS outputs, for each object signal and for each t/f-region, side information that refers to the individually selected t/f-representation. An additional parameter denoting the corresponding t/f-representation, may also be output.

Two methods for selecting the most suitable t/f-representation for each object signal are presented:

1. SI-AS based on source estimation: Each object signal is estimated from the signal mixture using the Side Information data computed on the basis of the H t/f-representations yielding H source estimations for each object signal. For each object, the estimation quality within each t/f-region $R(t_R,f_R)$ is assessed for each of the H t/f-representations by means of a source estimation performance measure. A simple example for such a measure is the achieved Signal to Distortion Ratio (SDR). More sophisticated, perceptual measures can also be utilized. Note that the SDR can be efficiently realized solely based on the parametric side information as defined within SAOC without knowledge of the original object signals or the signal mixture. The concept of the parametric estimation of SDR for the case of SAOC-based object estimation will be described below. For each t/f-region $R(t_R,f_R)$, the t/f-representation that yields the highest SDR is selected for the side information estimation and transmission, and for estimating the object signal at the decoder side.
2. SI-AS based on analyzing the H t/f-representations: Separately for each object, the sparseness of each of the H object signal representations is determined. Phrased differently, it is assessed how well the energy of the object signal within each of the different representations is concentrated on a few values or spread over all values. The t/f-representation, which represents the object signal most sparsely, is selected. The sparseness of the signal representations can be assessed, e.g., with measures that characterize the flatness or peakiness of the signal representations. The Spectral-Flatness Measure (SFM), the Crest-Factor (CF) and the L0-norm are examples of such measures. According to this embodiment, the suitability criterion may be based on a sparseness of at least the first time/frequency representation and the second time/frequency representation (and possibly further time/frequency representations) of a given audio object. The side information selector (SI-AS) is configured to select the side information among at least the first and second side information that corresponds to a time/frequency representation that represents the audio object signal $s_i$ most sparsely.

The parametric estimation of the SDR for the case of SAOC-based object estimation is now described.

Notations:

S Matrix of N original audio object signals

X Matrix of M mixture signals $D \in^{0\ M\times N}$ Downmix matrix

X=DS Calculation of downmix scene $S_{est}$ Matrix of N estimated audio object signals Within SAOC, the object signals are conceptually estimated from the mixture signals with the formula:

$$S_{est}=ED^*(DED^*)^{-1}X \text{ with } E=SS^*$$

Replacing X with DS gives:

$$S_{est}=ED^*(DED^*)^{-1}DS=TS$$

The energy of original object signal parts in the estimated object signals can be computed as:

$$E_{est}=S_{est}S_{est}=TSS^*T^*=TET^*$$

The distortion terms in the estimated signal can then be computed by:

$$E_{dist}=\text{diag}(E)-E_{est},$$

with diag(E) denoting a diagonal matrix that contains the energies of the original object signals. The SDR can then be computed by relating diag(E) to $E_{dist}$. For estimating the SDR in a manner relative to the target source energy in a certain t/f-region $R(t_R,f_R)$, the distortion energy calculation is carried out on each processed t/f-tile in the region $R(t_R,f_R)$, and the target and the distortion energies are accumulated over all t/f-tiles within the t/f-region $R(t_R,f_R)$.

Therefore, the suitability criterion may be based on a source estimation. In this case the side information selector (SI-AS) 56 may further comprise a source estimator configured to estimate at least a selected audio object signal of the plurality of audio object signals $s_i$ using the downmix signal X and at least the first information and the second information corresponding to the first and second time/frequency resolutions $TFR_1$, $TFR_2$, respectively. The source estimator thus provides at least a first estimated audio object signal $s_{i,\ estim1}$ and a second estimated audio object signal $s_{i,\ estim2}$ (possibly up to H estimated audio object signals $s_{i,\ estim\ H}$). The side information selector 56 also comprises a quality assessor configured to assess a quality of at least the first estimated audio object signal $s_{i,\ estim1}$ and the second estimated audio object signal $s_{i,\ estim2}$. Moreover, the quality assessor may be configured to assess the quality of at least the first estimated audio object signal $s_{i,\ estim1}$ and the second estimated audio object signal $s_{i,\ estim2}$ on the basis of a signal-to-distortion ratio SDR as a source estimation performance measure, the signal-to-distortion ratio SDR being determined solely on the basis of the side information PSI, in particular the estimated covariance matrix $E_{est}$.

The audio encoder according to some embodiments may further comprise a downmix signal processor that is configured to transform the downmix signal X to a representation that is sampled in the time/frequency domain into a plurality of time-slots and a plurality of (hybrid) sub-bands. The time/frequency region $R(t_R,f_R)$ may extend over at least two samples of the downmix signal X. An object-specific time/frequency resolution $TFR_h$ specified for at least one audio object may be finer than the time/frequency region $R(t_R,f_R)$. As mentioned above, in relation to the uncertainty principle of time/frequency representation the spectral resolution of a signal can be increased at the cost of the temporal resolution, or vice versa. Although the downmix signal sent from the audio encoder to an audio decoder is typically analyzed in the decoder by a time-frequency transform with a fixed predetermined time/frequency resolution, the audio decoder may still transform the analyzed downmix signal within a contemplated time/frequency region $R(t_R,f_R)$ object-individually to another time/frequency resolution that is more appropriate for extracting a given audio object $s_i$ from the downmix signal. Such a transform of the downmix signal at the decoder is called a zoom transform in this document. The zoom transform can be a temporal zoom transform or a spectral zoom transform.

Reducing the Amount of Side Information

In principle, in simple embodiments of the inventive system, side information for up to H t/f-representations has to be transmitted for every object and for every t/f-region $R(t_R,f_R)$ as separation at the decoder side is carried out by choosing from up to H t/f-representations. This large amount of data can be drastically reduced without significant loss of perceptual quality. For each object, it is sufficient to transmit for each t/f-region $R(t_R,f_R)$ the following information:

One parameter that globally/coarsely describes the signal content of the audio object in the t/f-region $R(t_R,f_R)$, e.g., the mean signal energy of the object in region $R(t_R,f_R)$.

A description of the fine structure of the audio object. This description is obtained from the individual t/f-representation that was selected for optimally estimating the audio object from the mixture. Note that the information on the fine structure can be efficiently described by parameterizing the difference between the coarse signal representation and the fine structure.

An information signal that indicates the t/f-representation to be used for estimating the audio object.

At the decoder, the estimation of a desired audio objects from the mixture at the decoder can be carried out as described in the following for each t/f-region $R(t_R,f_R)$.

The individual t/f-representation as indicated by the additional side information for this audio object is computed.

For separating the desired audio object, the corresponding (fine structure) object signal information is employed.

For all remaining audio objects, i.e., the interfering audio objects which have to be suppressed, the fine structure object signal information is used if the information is available for the selected t/f-representation. Otherwise, the coarse signal description is used. Another option is to use the available fine structure object signal information for a particular remaining audio object and to approximate the selected t/f-representation by, for example, averaging the available fine structure audio object signal information in sub-regions of the t/f-region $R(t_R,f_R)$: In this manner the t/f-resolution is not as fine as the selected t/f-representation, but still finer than the coarse t/f-representation.

SAOC Decoder with Enhanced Audio Object Estimation

Figure 7:
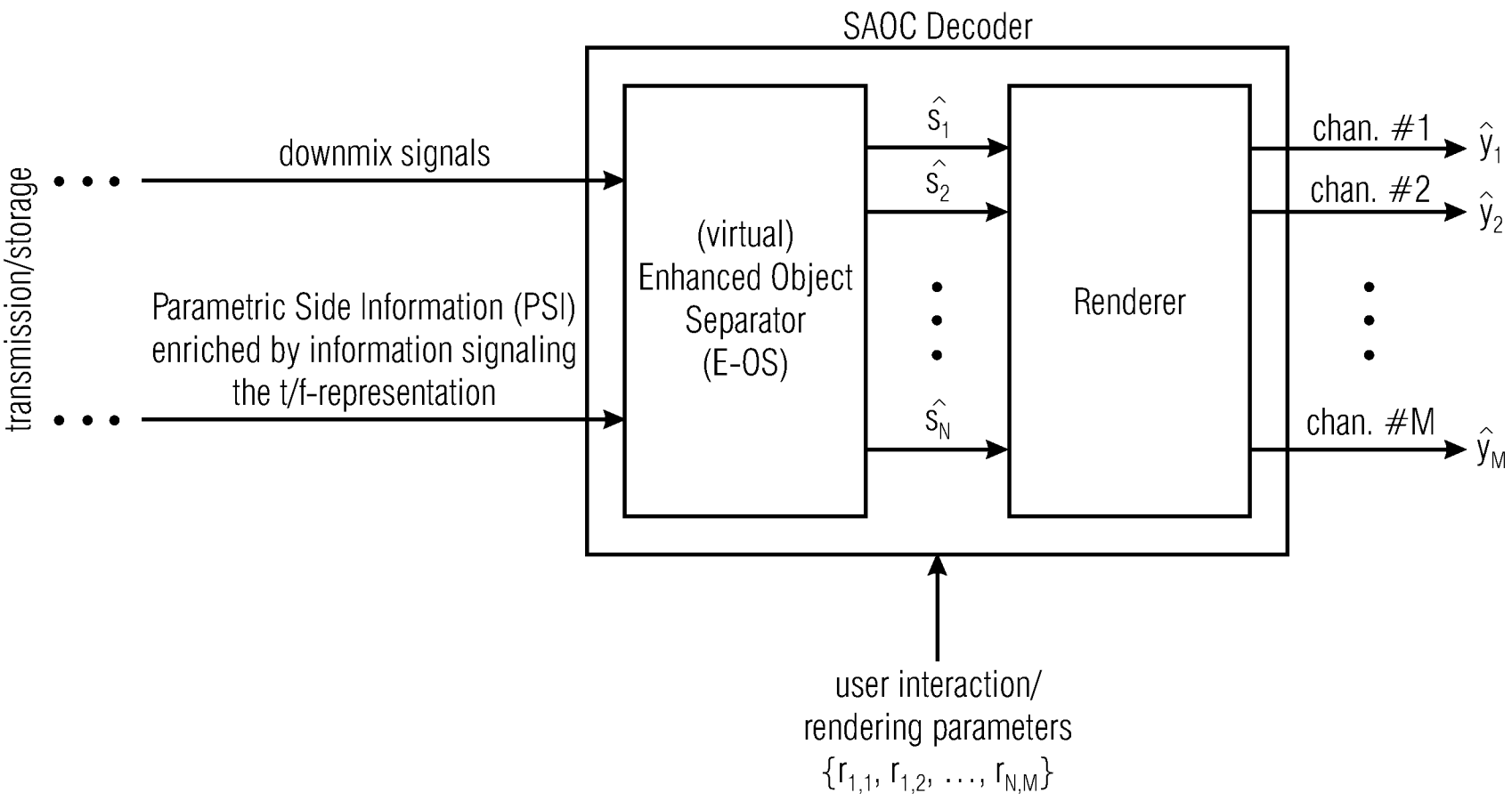
FIG. 7 schematically illustrates the SAOC decoding comprising an Enhanced (virtual) Object Separation (EOS) module.

FIG. 7 schematically illustrates the SAOC decoding comprising an Enhanced (virtual) Object Separation (E-OS) module and visualizes the principle on this example of an improved SAOC-decoder comprising a (virtual) Enhanced Object Separator (E-OS). The SAOC-decoder is fed with the signal mixture together with Enhanced Parametric Side Information (E-PSI). The E-PSI comprises information on the audio objects, the mixing parameters and additional information. By this additional side information, it is signaled to the virtual E-OS, which t/f-representation should be used for each object $s_1 \ldots s_N$ and for each t/f-region $R(t_R,f_R)$. For a given t/f-region $R(t_R,f_R)$, the object separator estimates each of the objects, using the individual t/f-representation that is signaled for each object in the side information.

Figure 8:
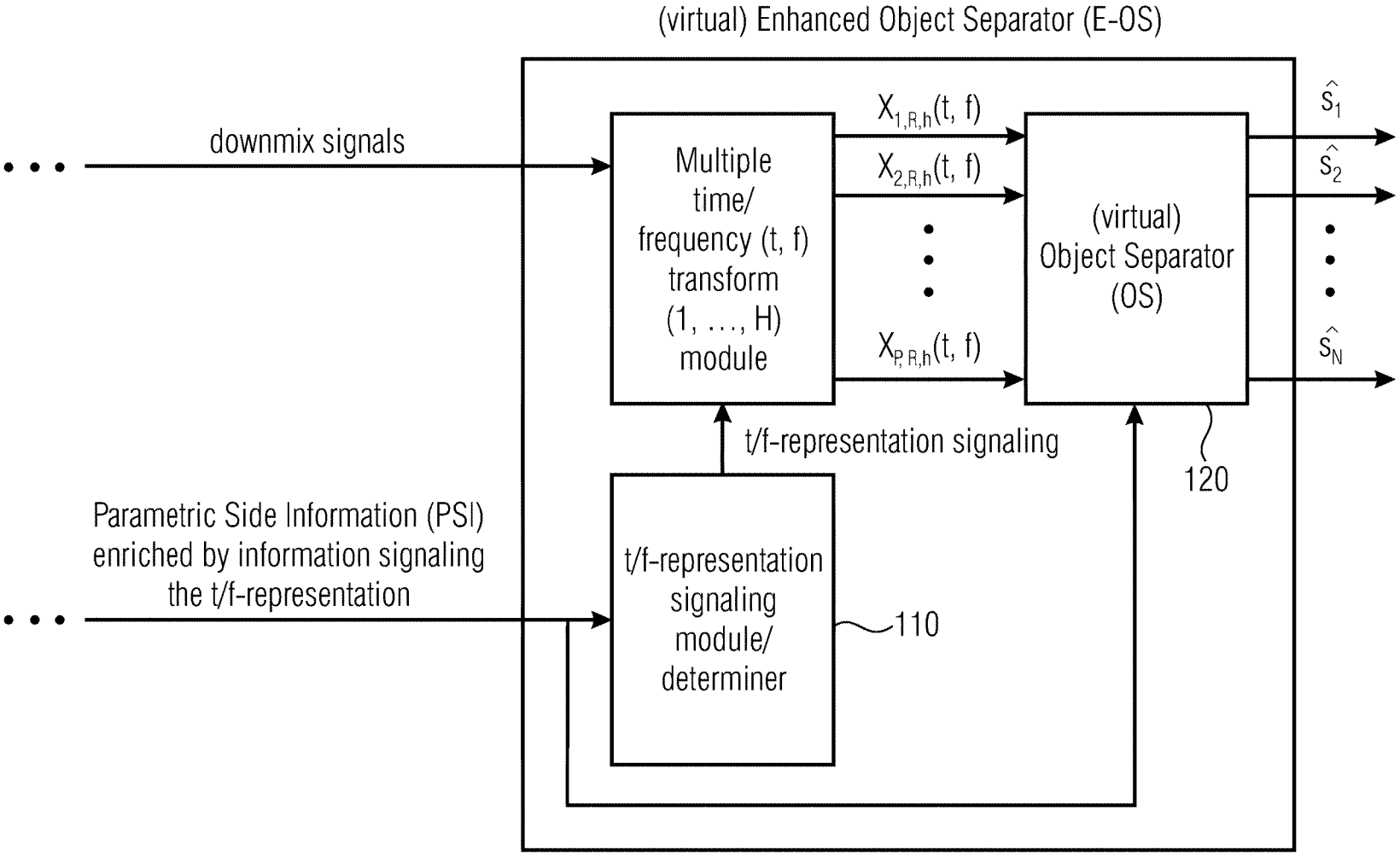
FIG. 8 shows a schematic block diagram of an enhanced object separation module (EOS-module)

FIG. 8 details the concept of the E-OS module. For a given t/f-region $R(t_R,f_R)$, the individual t/f-representation #h to compute on the P downmix signals is signaled by the t/f-representation signaling module 110 to the multiple t/f-transform module. The (virtual) Object Separator 120 conceptually attempts to estimate source $s_n$, based on the t/f-transform #h indicated by the additional side information. The (virtual) Object Separator exploits the information on the fine structure of the objects, if transmitted for the indicated t/f-transform #h, and uses the transmitted coarse description of the source signals otherwise. Note that the maximum possible number of different t/f-representations to be computed for each t/f-region $R(t_R,f_R)$ is H. The multiple time/frequency transform module may be configured to perform the above mentioned zoom transform of the P downmix signal(s).

Figure 9:
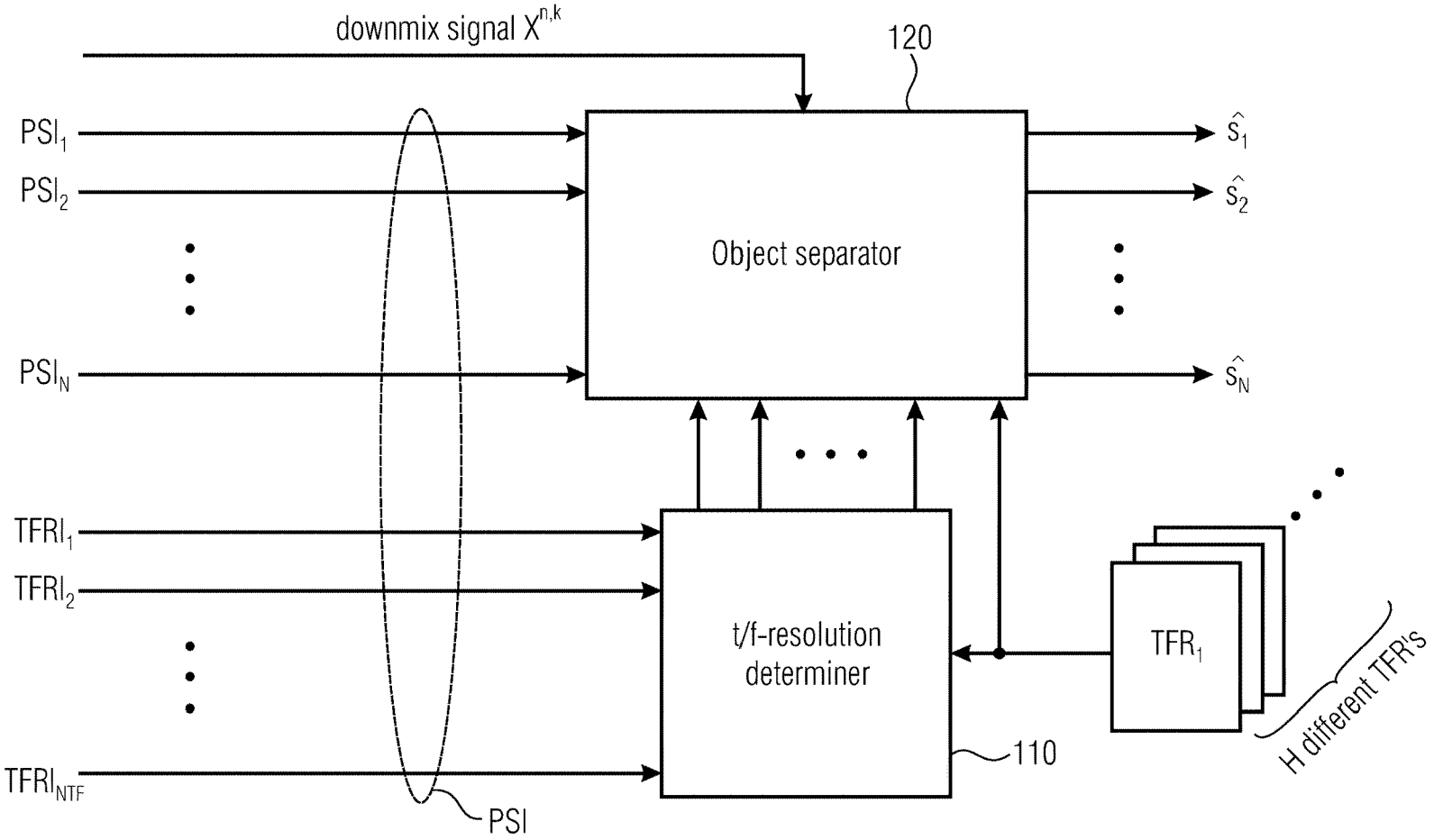
FIG. 9 is a schematic block diagram of an audio decoder according to embodiments.

FIG. 9 shows a schematic block diagram of an audio decoder for decoding a multi-object audio signal consisting of a downmix signal X and side information PSI. The side information PSI comprises object-specific side information $PSI_i$ with i=1 N for at least one audio object $s_i$ in at least one time/frequency region $R(t_R,f_R)$. The side information PSI also comprises object-specific time/frequency resolution information $TFRI_i$ with i=1 . . . NTF. The variable NTF indicates the number of audio objects for which the object-specific time/frequency resolution information is provided and NTF≤N. The object-specific time/frequency resolution information $TFRI_i$ may also be referred to as object-specific time/frequency representation information. In particular, the term "time/frequency resolution" should not be understood as necessarily meaning a uniform discretization of the time/frequency domain, but may also refer to non-uniform discretizations within a t/f-tile or across all the t/f-tiles of the full-band spectrum. Typically and advantageously, the time/frequency resolution is chosen such that one of both dimensions of a given t/f-tile has a fine resolution and the other dimension has a low resolution, e.g., for transient signals the temporal dimension has a fine resolution and the spectral resolution is coarse, whereas for stationary signals the spectral resolution is fine and the temporal dimension has a coarse resolution. The time/frequency resolution information $TFRI_i$ is indicative of an object-specific time/frequency resolution $TFR_h$ (h=1 . . . H) of the object-specific side information $PSI_i$ for the at least one audio object $s_i$ in the at least one time/frequency region $R(t_R,f_R)$. The audio decoder comprises an object-specific time/frequency resolution determiner 110 configured to determine the object-specific time/frequency resolution information $TFRI_i$ from the side information PSI for the at least one audio object $s_i$. The audio decoder further comprises an object separator 120 configured to separate the at least one audio object $s_i$ from the downmix signal X using the object-specific side information $PSI_i$ in accordance with the object-specific time/frequency resolution $TFR_i$. This means that the object-specific side information $PSI_i$ has the object-specific time/frequency resolution $TFR_i$ specified by the object-specific time/frequency resolution information $TFRI_i$, and that this object-specific time/frequency resolution is taken into account when performing the object separation by the object separator 120.

The object-specific side information ($PSI_i$) may comprise a fine structure object-specific side information $fsl_i^{\eta,\kappa}$, $fsc_{i,j}^{\eta,\kappa}$ for the at least one audio object $s_i$ in at least one time/frequency region $R(t_R,f_R)$. The fine structure object-specific side information $fsl_i^{\eta,\kappa}$ may be a fine structure level information describing how the level (e.g., signal energy, signal power, amplitude, etc. of the audio object) varies within the time/frequency region $R(t_R,f_R)$. The fine structure object-specific side information $fsl_{i,j}^{\eta,\kappa}$ may be an inter-object correlation information of the audio objects i and j, respectively. Here, the fine structure object-specific side information $fsl_i^{\eta,\kappa}$, $fsl_{i,j}^{\eta,\kappa}$ is defined on a time/frequency grid according to the object-specific time/frequency resolution $TFR_i$, with fine-structure time-slots η and fine-structure (hybrid) sub-bands κ. This topic will be described below in the context of FIG. 12. For now, at least three basic cases can be distinguished:

a) The object-specific time/frequency resolution $TFR_i$ corresponds to the granularity of QMF time-slots and (hybrid) sub-bands. In this case η=n and κ=k.

b) The object-specific time/frequency resolution information $TFRI_i$ indicates that a spectral zoom transform has to be performed within the time/frequency region $R(t_R, f_R)$ or a portion thereof. In this case, each (hybrid) sub-band k is subdivided into two or more fine structure (hybrid) sub-bands $\kappa_k$, $\kappa_{k+1}$, . . . so that the spectral resolution is increased. In other words, the fine structure (hybrid) sub-bands $\kappa_k$, $\kappa_{k+1}$, . . . are fractions of the original (hybrid) sub-band. In exchange, the temporal resolution is decreased, due to the time/frequency uncertainty. Hence, the fine structure time-slot $\eta$ comprises two or more of the time-slots n, n+1, . . . .

c) The object-specific time/frequency resolution information $TFRI_i$ indicates that a temporal zoom transform has to be performed within the time/frequency region $R(t_R, f_R)$ or a portion thereof. In this case, each time-slot n is subdivided into two or more fine structure time-slots $\eta_n$, $\eta_{n+1}$, . . . so that the temporal resolution is increased. In other words, the fine structure time-slots $\eta_n$, $\eta_{n+1}$, . . . are fractions of the time-slot n. In exchange, the spectral resolution is decreased, due to the time/frequency uncertainty. Hence, the fine structure (hybrid) sub-band $\kappa$ comprises two or more of the (hybrid) sub-bands k, k+1, . . . .

The side information may further comprise coarse object-specific side information $OLD_i$, $IOC_{i,j}$, and/or an absolute energy level $NRG_i$ for at least one audio object $s_i$ in the considered time/frequency region $R(t_R,f_R)$. The coarse object-specific side information $OLD_i$, $IOC_{i,j}$, and/or $NRG_i$ is constant within the at least one time/frequency region $R(t_R,f_R)$.

Figure 10:
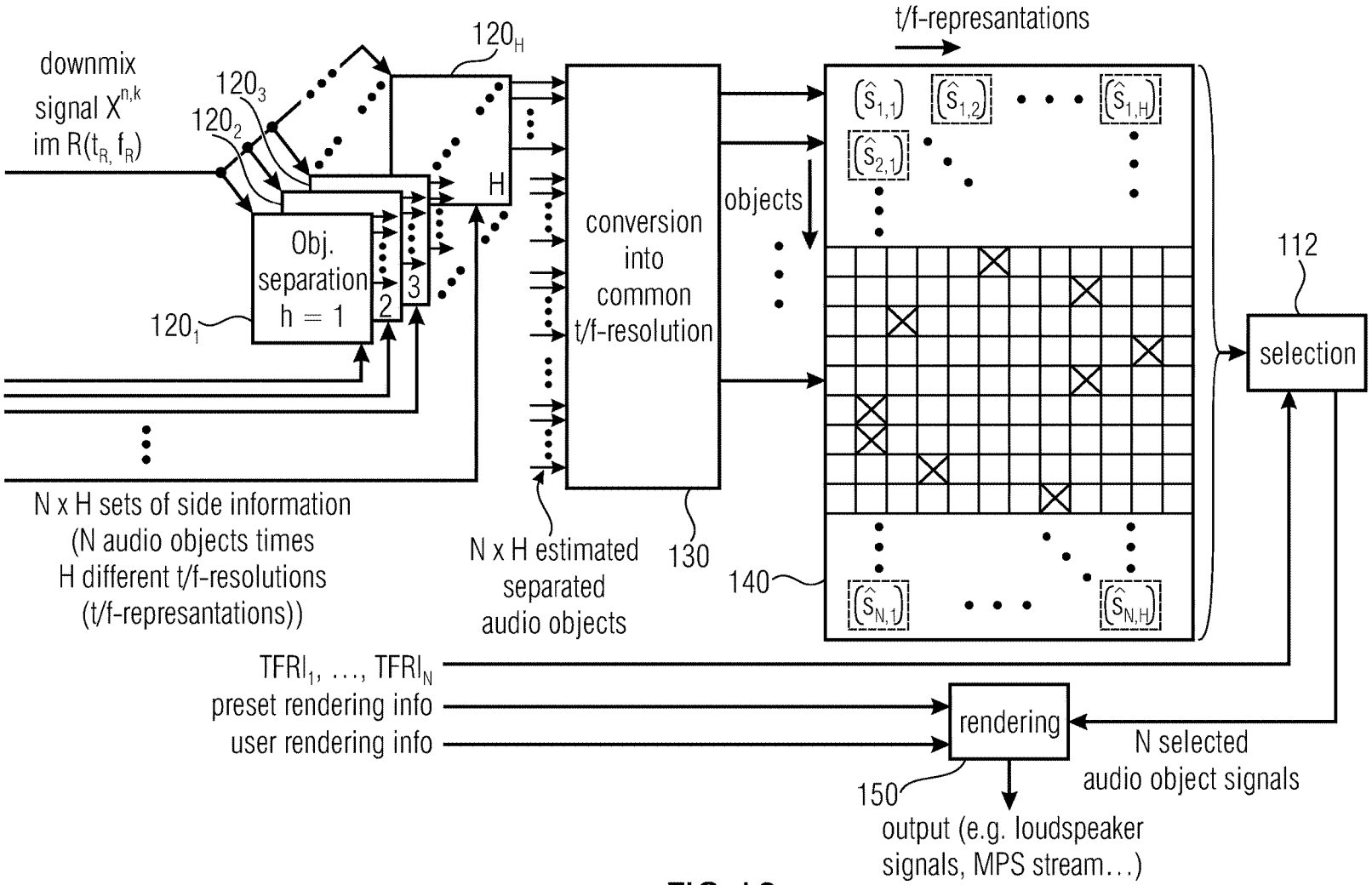
FIG. 10 is a schematic block diagram of an audio decoder that decodes H alternative t/f-representations and subsequently selects object-specific ones, according to a relatively simple embodiment.

FIG. 10 shows a schematic block diagram of an audio decoder that is configured to receive and process the side information for all N audio objects in all H t/f-representations within one time/frequency tile $R(t_R,f_R)$. Depending on the number N of audio objects and the number H of t/f-representations, the amount of side information to be transmitted or stored per t/f-region $R(t_R,f_R)$ may become quite large so that the concept shown in FIG. 10 is more likely to be used for scenarios with a small number of audio objects and different t/f-representations. Still, the example illustrated in FIG. 10 provides an insight in some of the principles of using different object-specific t/f-representations for different audio objects.

Briefly, according to the embodiment shown in FIG. 10 the entire set of parameters (in particular OLD and IOC) are determined and transmitted/stored for all H t/f-representations of interest. In addition, the side information indicates for each audio object in which specific t/f-representation this audio object should be extracted/synthesized. In the audio decoder, the object reconstruction $\hat{S}_h$ in all t/f-representations h are performed. The final audio object is then assembled, over time and frequency, from those object-specific tiles, or t/f-regions, that have been generated using the specific t/f-resolution(s) signaled in the side information for the audio object and the tiles of interest.

The downmix signal X is provided to a plurality of object separators $\mathbf{120}_1$ to $\mathbf{120}_H$. Each of the object separators $\mathbf{120}_1$ to $\mathbf{120}_H$ is configured to perform the separation task for one specific t/f-representation. To this end, each object separator $\mathbf{120}_1$ to $\mathbf{120}_H$ further receives the side information of the N different audio objects $s_1$ to $s_N$ in the specific t/f-representation that the object separator is associated with. Note that FIG. 10 shows a plurality of H object separators for illustrative purposes only. In alternative embodiments, the H separation tasks per t/f-region $R(t_R,f_R)$ could be performed by fewer object separators, or even by a single object separator. According to further possible embodiments, the separation tasks may be performed on a multi-purpose processor or on a multi-core processor as different threads. Some of the separation tasks are computationally more intensive than others, depending on how fine the corresponding t/f-representation is. For each t/f-region $R(t_R,f_R)$ N x H sets of side information are provided to the audio decoder.

The object separators $\mathbf{120}_1$ to $\mathbf{120}_H$ provide N x H estimated separated audio objects $\hat{s}_{1,1} \ldots \hat{s}_{N,H}$ which may be fed to an optional t/f-resolution converter 130 in order to bring the estimated separated audio objects $\hat{s}_{1,1} \ldots \hat{s}_{N,H}$ to a common t/f-representation, if this is not already the case. Typically, the common t/f-resolution or representation may be the true t/f-resolution of the filter bank or transform the general processing of the audio signals is based on, i.e., in case of MPEG SAOC the common resolution is the granularity of QMF time-slots and (hybrid) sub-bands. For illustrative purposes it may be assumed that the estimated audio objects are temporarily stored in a matrix 140. In an actual implementation, estimated separated audio objects that will not be used later may be discarded immediately or are not even calculated in the first place. Each row of the matrix 140 comprises H different estimations of the same audio object, i.e., the estimated separated audio object determined on the basis of H different t/f-representations. The middle portion of the matrix 140 is schematically denoted with a grid. Each matrix element $\hat{s}_{1,1} \ldots \hat{s}_{N,H}$ corresponds to the audio signal of the estimated separated audio object. In other words, each matrix element comprises a plurality of time-slot/sub-band samples within the target t/f-region $R(t_R,f_R)$ (e.g., 7 time-slots×3 sub-bands=21 time-slot/sub-band samples in the example of FIG. 11).

The audio decoder is further configured to receive the object-specific time/frequency resolution information $TFRI_1$ to $TFRI_N$ for the different audio objects and for the current t/f-region $R(t_R,f_R)$. For each audio object i, the object-specific time/frequency resolution information $TFRI_1$ indicates which of the estimated separated audio objects $\hat{s}_{i,H}$ should be used to approximately reproduce the original audio object. The object-specific time/frequency resolution information has typically been determined by the encoder and provided to the decoder as part of the side information. In FIG. 10, the dashed boxes and the crosses in the matrix 140 indicate which of the t/f-representations have been selected for each audio object. The selection is made by a selector 112 that receives the object-specific time/frequency resolution information $TFRI_1 \ldots TFRI_N$.

The selector 112 outputs N selected audio object signals that may be further processed. For example, the N selected audio object signals may be provided to a renderer 150 configured to render the selected audio object signals to an available loudspeaker setup, e.g., stereo or 5.1 loudspeaker setup. To this end, the renderer 150 may receive preset rendering information and/or user rendering information that describes how the audio signals of the estimated separated audio objects should be distributed to the available loudspeakers. The renderer 150 is optional and the estimated separated audio objects $\hat{s}_{i,1} \ldots \hat{s}_{i,H}$ at the output of the selector 112 may be used and processed directly. In alternative embodiments, the renderer 150 may be set to extreme settings such as "solo mode" or "karaoke mode." In the solo mode, a single estimated audio object is selected to be rendered to the output signal. In the karaoke mode, all but one estimated audio object are selected to be rendered to the output signal. Typically the lead vocal part is not rendered, but the accompaniment parts are. Both modes are highly demanding in terms of separation performance, as even little crosstalk is perceivable.

Figure 11:
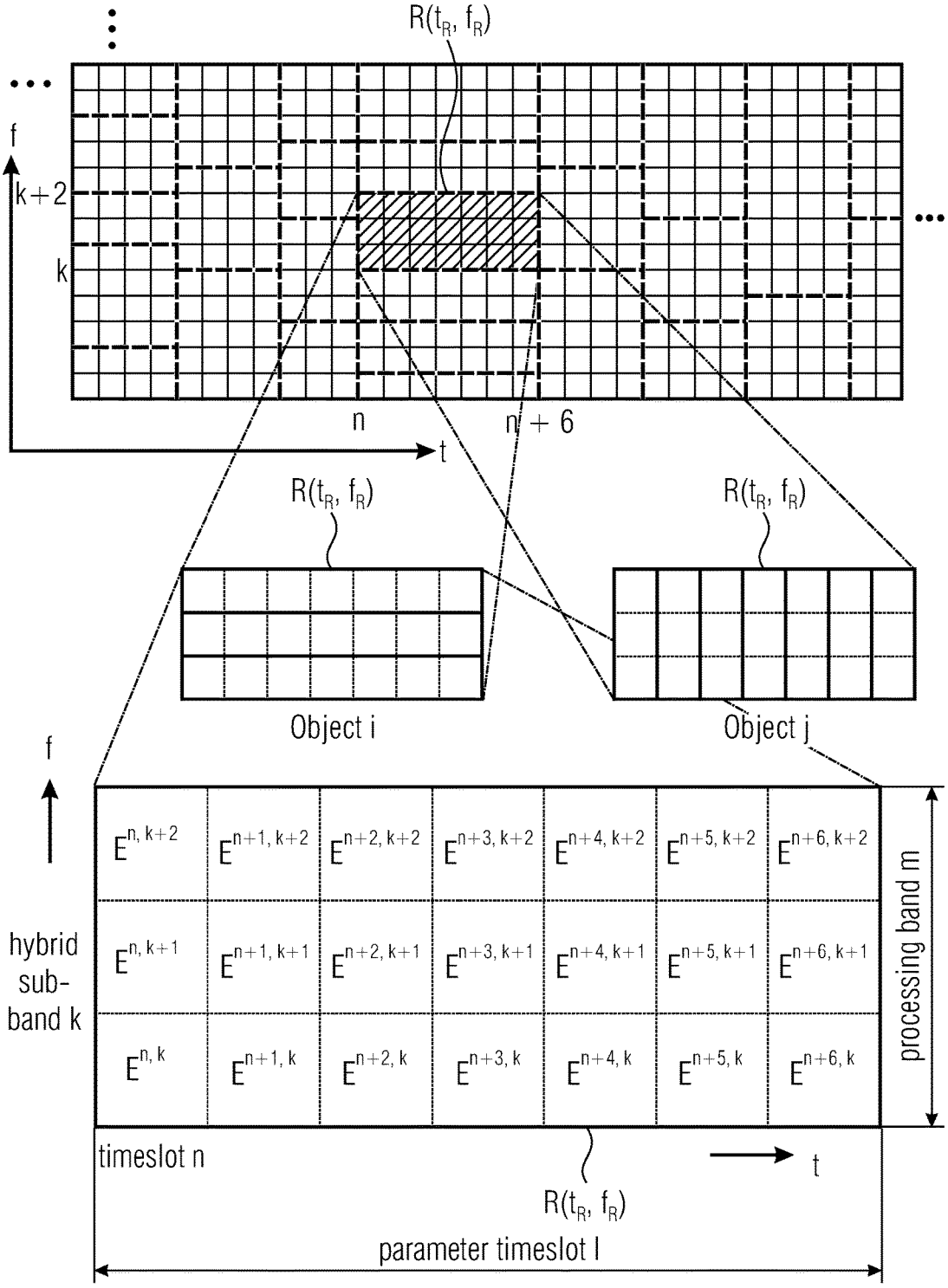
FIG. 11 schematically illustrates a t/f-region $R(t_R,f_R)$ represented in different t/f-representations and the resulting consequences on the determination of an estimated covariance matrix E within the t/f-region.

FIG. 11 schematically illustrates how the fine structure side information $fsl_i^{n,k}$ and the coarse side information for an audio object i may be organized. The upper part of FIG. 11 illustrates a portion of the time/frequency domain that is sampled according to time-slots (typically indicated by the index n in the literature and in particular audio coding-related ISO/IEC standards) and (hybrid) sub-bands (typically identified by the index k in the literature). The time/frequency domain is also divided into different time/frequency regions (graphically indicated by thick dashed lines in FIG. 11). Typically one t/f-region comprises several time-slot/sub-band samples. One t/f-region $R(t_R,f_R)$ shall serve as a representative example for other t/f-regions. The exemplary considered t/f-region $R(t_R,f_R)$ extends over seven time-slots n to n+6 and three (hybrid) sub-bands k to k+2 and hence comprises 21 time-slot/sub-band samples. We now assume two different audio objects i and j. The audio object i may have a substantially tonal characteristic within the t/f-region $R(t_R,f_R)$, whereas the audio object j may have a substantially transient characteristic within the t/f-region $R(t_R,f_R)$. In order to more adequately represent these different characteristics of the audio objects i and j, the t/f-region $R(t_R,f_R)$ may be further subdivided in the spectral direction for the audio object i and in the temporal direction for audio object j. Note that the t/f-regions are not necessarily equal or uniformly distributed in the t/f-domain, but can be adapted in size, position, and distribution according to the needs of the audio objects. Phrased differently, the downmix signal X is sampled in the time/frequency domain into a plurality of time-slots and a plurality of (hybrid) sub-bands. The time/frequency region $R(t_R,f_R)$ extends over at least two samples of the downmix signal X. The object-specific time/frequency resolution $TFR_h$ is finer than the time/frequency region $R(t_R,f_R)$.

When determining the side information for the audio object i at the audio encoder side, the audio encoder analyzes the audio object i within the t/f-region $R(t_R,f_R)$ and determines a coarse side information and a fine structure side information. The coarse side information may be the object level difference $OLD_1$, the inter-object covariance $IOC_{i,j}$ and/or an absolute energy level $NRG_i$, as defined in, among others, the SAOC standard ISO/IEC 23003-2. The coarse side information is defined on a t/f-region basis and typically provides backward compatibility as existing SAOC decoders use this kind of side information. The fine structure object-specific side information $fsl_i^{n,k}$ for the object i provides three further values indicating how the energy of the audio object i is distributed among three spectral sub-regions. In the illustrated case, each of the three spectral sub-regions corresponds to one (hybrid) sub-band, but other distributions are also possible. It may even be envisaged to make one spectral sub-region smaller than another spectral sub-region in order to have a particularly fine spectral resolution available in the smaller spectral sub-band. In a similar manner, the same t/f-region $R(t_R,f_R)$ may be subdivided into several temporal sub-regions for more adequately representing the content of audio object j in the t/f-region $R(t_R,f_R)$.

The fine structure object-specific side information $fsl_i^{n,k}$ may describe a difference between the coarse object-specific side information (e.g., $OLD_i$, $IOC_{i,j}$, and/or $NRG_i$) and the at least one audio object $s_i$.

The lower part of FIG. 11 illustrates that the estimated covariance matrix E varies over the t/f-region $R(t_R,f_R)$ due to the fine structure side information for the audio objects i and j. Other matrices or values that are used in the object separation task may also be subject to variations within the t/f-region $R(t_R,f_R)$. The variation of the covariance matrix E (and possible of other matrices or values) has to be taken into account by the object separator 120. In the illustrated case, a different covariance matrix E is determined for every time-slot/sub-band sample of the t/f-region $R(t_R,f_R)$. In case only one of the audio objects has a fine spectral structure associated with it, e.g., the object i, the covariance matrix E would be constant within each one of the three spectral sub-regions (here: constant within each one of the three (hybrid) sub-bands, but generally other spectral sub-regions are possible, as well).

The object separator 120 may be configured to determine the estimated covariance matrix $E^{n,k}$ with elements $e_{i,j}^{n,k}$ of the at least one audio object $s_i$ and at least one further audio object $s_i$ according to $$e_{i,j}^{n,k}=\sqrt{fsl_i^{n,k}fsl_j^{n,k}}fsc_{i,j}^{n,k},$$

wherein

- $e_{i,j}^{n,k}$ is the estimated covariance of audio objects i and j for time-slot n and (hybrid) sub-band k;
- $fsl_i^{n,k}$ and $fsl_j^{n,k}$ are the object-specific side information of the audio objects i and j for time-slot n and (hybrid) sub-band k;
- $fsc_{i,j}^{n,k}$ is an inter object correlation information of the audio objects i and j, respectively, for time-slot n and (hybrid) sub-band k.

At least one of $fsl_i^{n,k}$, $fsl_j^{n,k}$, $fsl_{i,j}^{n,k}$ and varies within the time/frequency region $R(t_R,f_R)$ according to the object-specific time/frequency resolution $TFR_h$ for the audio objects i or j indicated by the object-specific time/frequency resolution information $TFRI_i$, $TFRI_j$, respectively. The object separator 120 may be further configured to separate the at least one audio object $s_i$ from the downmix signal X using the estimated covariance matrix $E^{n,k}$ in the manner described above.

An alternative to the approach described above has to be taken when the spectral or temporal resolution is increased from the resolution of the underlying transform, e.g., with a subsequent zoom transform. In such a case, the estimation of the object covariance matrix needs to be done in the zoomed domain, and the object reconstruction takes place also in the zoomed domain. The reconstruction result can then be inverse transformed back to the domain of the original transform, e.g., (hybrid) QMF, and the interleaving of the tiles into the final reconstruction takes place in this domain. In principle, the calculations operate in the same way as they would in the case of utilizing a differing parameter tiling with the exception of the additional transforms.

Figure 12:
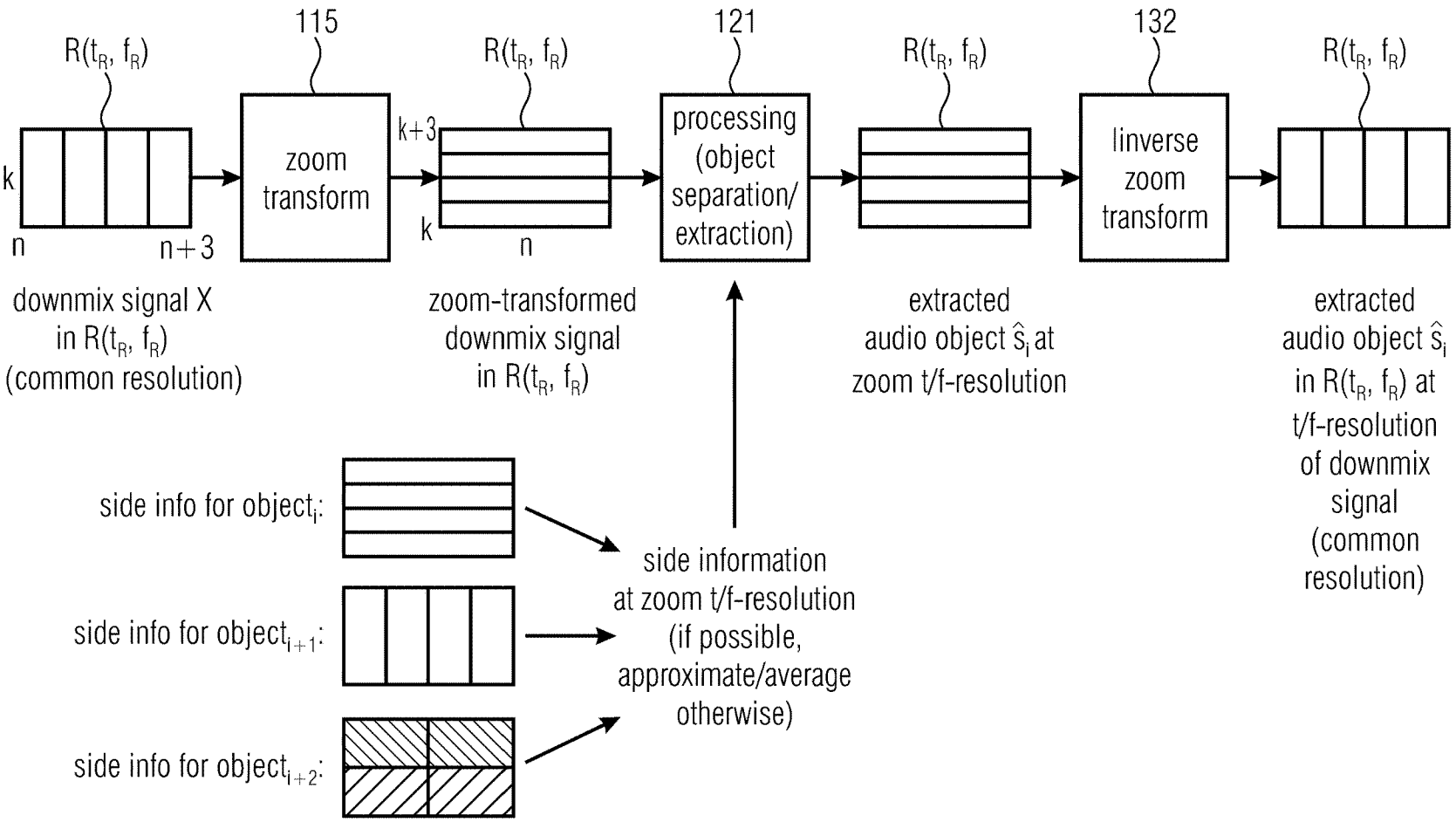
FIG. 12 schematically illustrates a concept for audio object separation using a zoom transform in order to perform the audio object separation in a zoomed time/frequency representation.

FIG. 12 schematically illustrates the zoom transform through the example of zoom in the spectral axis, the processing in the zoomed domain, and the inverse zoom transform. We consider the downmix in a time/frequency region $R(t_R,f_R)$ at the t/f-resolution of the downmix signal defined by the time-slots n and the (hybrid) sub-bands k. In the example shown in FIG. 12, the time-frequency region $R(t_R,f_R)$ spans four time-slots n to n+3 and one sub-band k. The zoom transform may be performed by a signal time/frequency transform unit 115. The zoom transform may be a temporal zoom transform or, as shown in FIG. 12, a spectral zoom transform. The spectral zoom transform may be performed by means of a DFT, a STFT, a QMF-based analysis filterbank, etc. The temporal zoom transform may be performed by means of an inverse DFT, an inverse STFT, an inverse QMF-based synthesis filterbank, etc. In the example of FIG. 12, the downmix signal X is converted from the downmix signal time/frequency representation defined by time-slots n and (hybrid) sub-bands k to the spectrally zoomed t/f-representation spanning only one object-specific time-slot η, but four object-specific (hybrid) sub-bands κ to κ+3. Hence, the spectral resolution of the downmix signal within the time/frequency region $R(t_R,f_R)$ has been increased by a factor 4 at the cost of the temporal resolution.

The processing is performed at the object-specific time/frequency resolution $TFR_h$ by the object separator 121 which also receives the side information of at least one of the audio objects in the object-specific time/frequency resolution $TFR_h$. In the example of FIG. 12, the audio object i is defined by side information in the time/frequency region $R(t_R,f_R)$ that matches the object-specific time/frequency resolution $TFR_h$, i.e., one object-specific time-slot $r_i$ and four object-specific (hybrid) sub-bands η to η+3. For illustrative purposes, the side information for two further audio objects i+1 and i+2 are also schematically illustrated in FIG. 12. Audio object i+1 is defined by side information having the time/frequency resolution of the downmix signal. Audio object i+2 is defined by side information having a resolution of two object-specific time-slots and two object-specific (hybrid) sub-bands in the time/frequency region $R(t_R,f_R)$. For the audio object i+1, the object separator 121 may consider the coarse side information within the time/frequency region $R(t_R,f_R)$. For audio object i+2 the object separator 121 may consider two spectral average values within the time/frequency region $R(t_R,f_R)$, as indicated by the two different hatchings. In the general case, a plurality of spectral average values and/or a plurality of temporal average values may be considered by the object separator 121, if the side information for the corresponding audio object is not available in the exact object-specific time/frequency resolution $TFR_h$ that is currently processed by the object separator 121, but is discretized more finely in the temporal and/or spectral dimension than the time/frequency region $R(t_R,f_R)$. In this manner, the object separator 121 benefits from the availability of object-specific side information that is discretized finer than the coarse side information (e.g., OLD, IOC, and/or NRG), albeit not necessarily as fine as the object-specific time/frequency resolution $TFR_h$ currently processed by the object separator 121.

The object separator 121 outputs at least one extracted audio object $\hat{s}_i$ for the time/frequency region $R(t_R,f_R)$ at the object-specific time/frequency resolution (zoom t/f-resolution). The at least one extracted audio object $\hat{s}_i$ is then inverse zoom transformed by an inverse zoom transformer 132 to obtain the extracted audio object $\hat{s}_i$ in $R(t_R,f_R)$ at the time/frequency resolution of the downmix signal or at another desired time/frequency resolution. The extracted audio object $\hat{s}_i$ in $R(t_R,f_R)$ is then combined with the extracted audio object $\hat{s}_i$ in other time/frequency regions, e.g., $R(t_R-1,f_R-1)$, $R(t_R-1,f_R)$, $R(t_R+1,f_R+1)$, in order to assemble the extracted audio object $\hat{s}_i$.

According to corresponding embodiments, the audio decoder may comprise a downmix signal time/frequency transformer 115 configured to transform the downmix signal X within the time/frequency region $R(t_R,f_R)$ from a downmix signal time/frequency resolution to at least the object-specific time/frequency resolution $TFR_h$ of the at least one audio object $s_i$ to obtain a re-transformed downmix signal $X^{\eta,\kappa}$. The downmix signal time/frequency resolution is related to downmix time-slots n and downmix (hybrid) sub-bands k. The object-specific time/frequency resolution $TFR_h$ is related to object-specific time-slots η and object-specific (hybrid) sub-bands κ. The object-specific time-slots η may be finer or coarser than the downmix time-slots n of the downmix time/frequency resolution. Likewise, the object-specific (hybrid) sub-bands κ may be finer or coarser than the downmix (hybrid) sub-bands of the downmix time/frequency resolution. As explained above in relation to the uncertainty principle of time/frequency representation, the spectral resolution of a signal can be increased at the cost of the temporal resolution, and vice versa. The audio decoder may further comprise an inverse time/frequency transformer 132 configured to time/frequency transform the at least one audio object $s_i$ within the time/frequency region $R(t_R,f_R)$ from the object-specific time/frequency resolution $TFR_h$ back to the downmix signal time/frequency resolution. The object separator 121 is configured to separate the at least one audio object $s_i$ from the downmix signal X at the object-specific time/frequency resolution $TFR_h$.

In the zoomed domain, the estimated covariance matrix $E^{\eta,\kappa}$ is defined for the object-specific time-slots η and the object-specific (hybrid) sub-bands κ. The above-mentioned formula for the elements of the estimated covariance matrix of the at least one audio object $s_i$ and at least one further audio object sj may be expressed in the zoomed domain as:

$$e_{i,j}^{\eta,\kappa}=\sqrt{fsl_i^{\eta,\kappa}fsl_j^{\eta,\kappa}}fsc_{i,j}^{\eta,\kappa},$$

wherein

- $fsl_i^{\eta,\kappa}$ is the estimated covariance of audio objects i and j for object-specific time-slot η and object-specific (hybrid) sub-band κ;
- $fsl_i^{\eta,\kappa}$ and $fsl_j^{\eta,\kappa}$ are the object-specific side information of the audio objects i and j for object-specific time-slot η and object-specific (hybrid) sub-band κ;
- $fsl_{i,j}^{\eta,\kappa}$ is an inter-object correlation information of the audio objects i and j, respectively, for object-specific time-slot η and object-specific (hybrid) sub-band κ.

As explained above, the further audio object j might not be defined by side information that has the object-specific time/frequency resolution $TFR_h$ of the audio object i so that the parameters $fsl_j^{\eta,\kappa}$ and $fsl_{i,j}^{\eta,\kappa}$ may not be available or determinable at the object-specific time/frequency resolution $TFR_h$. In this case, the coarse side information of audio object j in $R(t_R,f_R)$ or temporally averaged values or spectrally averaged values may be used to approximate the parameters $fsl_j^{\eta,\kappa}$ and $fsl_{i,j}^{\eta,\kappa}$ in the time/frequency region $R(t_R,f_R)$ or in sub-regions thereof.

Also at the encoder side, the fine structure side information should typically be considered. In an audio encoder according to embodiments the side information determiner (t/f-SIE) 55-1 . . . 55-H is further configured to provide fine structure object-specific side information $fsl_i^{n,k}$ or $fsl_i^{\eta,\kappa}$ and coarse object-specific side information OLDi as a part of at least one of the first side information and the second side information. The coarse object-specific side information $OLD_i$ is constant within the at least one time/frequency region $R(t_R,f_R)$. The fine structure object-specific side information $fsl_i^{n,k}$, $fsl_i^{\eta,\kappa}$ may describe a difference between the coarse object-specific side information $OLD_i$ and the at least one audio object $s_i$. The inter-object correlations $IOC_{i,j}$ and $fsl_{i,j}^{n,k}$, $fsl_{i,j}^{\eta,\kappa}$ may be processed in an analog manner, as well as other parametric side information.

Figure 13:
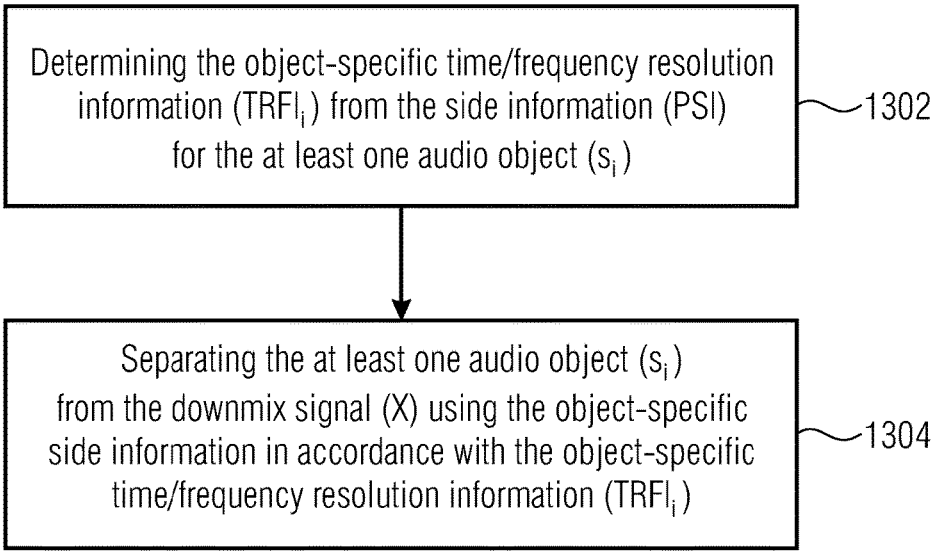
FIG. 13 shows a schematic flow diagram of a method for decoding a downmix signal with associated side information.

FIG. 13 shows a schematic flow diagram of a method for decoding a multi-object audio signal consisting of a downmix signal X and side information PSI. The side information comprises object-specific side information $PSI_i$ for at least one audio object $s_i$ in at least one time/frequency region $R(t_R,f_R)$, and object-specific time/frequency resolution information $TFRI_i$ indicative of an object-specific time/frequency resolution $TFR_h$ of the object-specific side information for the at least one audio object $s_i$ in the at least one time/frequency region $R(t_R,f_R)$. The method comprises a step 1302 of determining the object-specific time/frequency resolution information $TFRI_i$ from the side information PSI for the at least one audio object $s_i$. The method further comprises a step 1304 of separating the at least one audio object $s_i$ from the downmix signal X using the object-specific side information in accordance with the object-specific time/frequency resolution $TFRI_i$.

Figure 14:
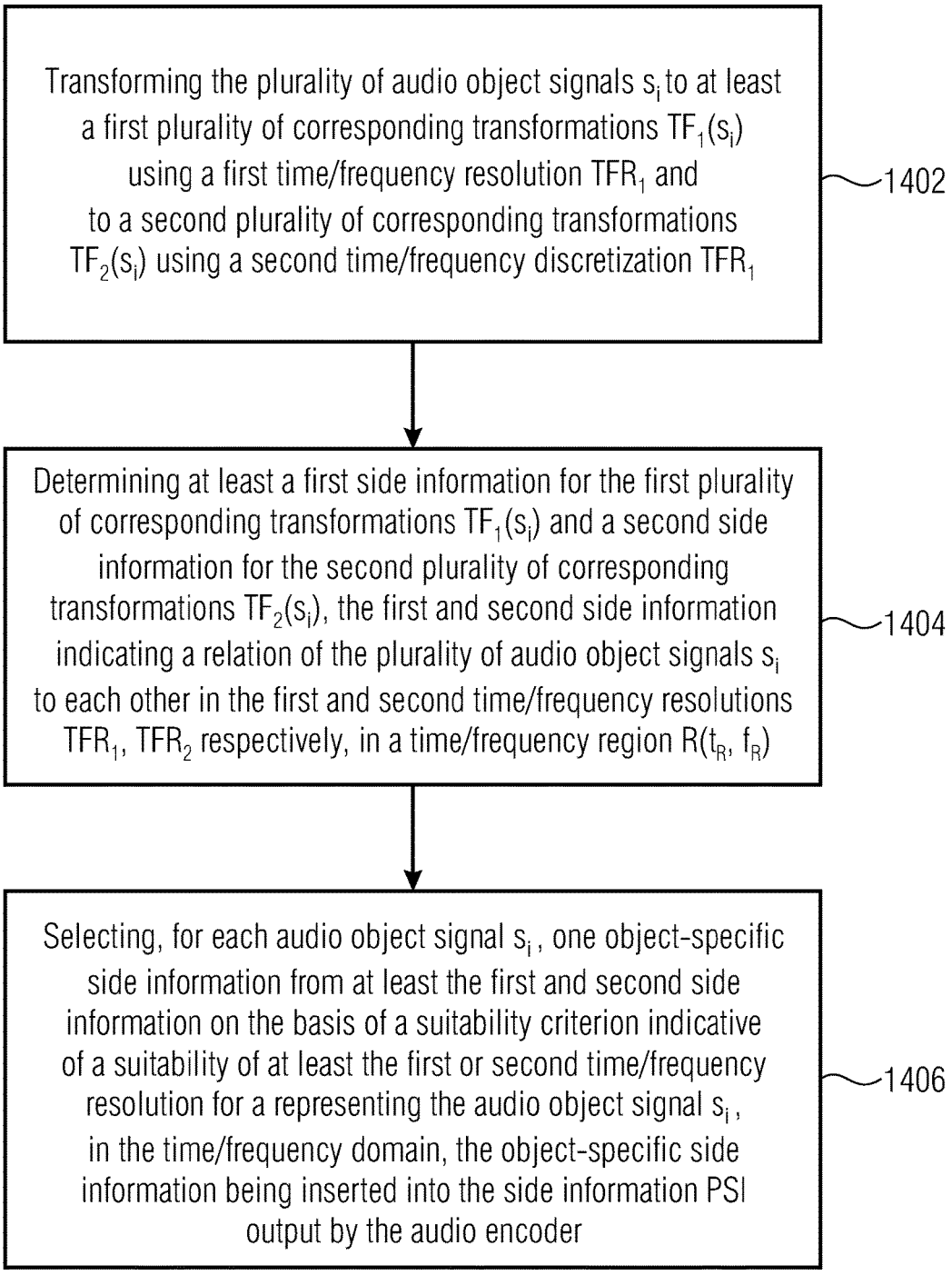
FIG. 14 shows a schematic flow diagram of a method for encoding a plurality of audio objects to a downmix signal and associated side information.

FIG. 14 shows a schematic flow diagram of a method for encoding a plurality of audio object signals $s_1$ to a downmix signal X and side information PSI according to further embodiments. The audio encoder comprises transforming the plurality of audio object signals $s_i$ to at least a first plurality of corresponding transformations $s_{1,1}(t,f) \ldots s_{N,1}(t,f)$ at a step 1402. A first time/frequency resolution $TFR_1$ is used to this end. The plurality of audio object signals $s_i$ are also transformed at least to a second plurality of corresponding transformations $s_{1,2}(t,f) \ldots s_{N,2}(t,f)$ using a second time/frequency discretization $TFR_2$. At a step 1404 at least a first side information for the first plurality of corresponding transformations $s_{1,1}(t,f) \ldots s_{N,1}(t,f)$ and a second side information for the second plurality of corresponding transformations $s_{1,2}(t,f) \ldots s_{N,2}(t,f)$ are determined. The first and second side information indicate a relation of the plurality of audio object signals $s_i$ to each other in the first and second time/frequency resolutions $TFR_1$, $TFR_2$, respectively, in a time/frequency region $R(t_R,f_R)$. The method also comprises a step 1406 of selecting, for each audio object signal $s_i$, one object-specific side information from at least the first and second side information on the basis of a suitability criterion indicative of a suitability of at least the first or second time/frequency resolution for representing the audio object signal $s_i$ in the time/frequency domain, the object-specific side information being inserted into the side information PSI output by the audio encoder.

Backward Compatibility with SAOC

The proposed solution advantageously improves the perceptual audio quality, possibly even in a fully decoder-compatible way. By defining the t/f-regions $R(t_R,f_R)$ to be congruent to the t/f-grouping within state-of-the-art SAOC, existing standard SAOC decoders can decode the backward compatible portion of the PSI and produce reconstructions of the objects on a coarse t/f-resolution level. If the added information is used by an enhanced SAOC decoder, the perceptual quality of the reconstructions is considerably improved. For each audio object, this additional side information comprises the information, which individual t/f-representation should be used for estimating the object, together with a description of the object fine structure based on the selected t/f-representation.

Additionally, if an enhanced SAOC decoder is running on limited resources, the enhancements can be ignored, and a basic quality reconstruction can still be obtained requiring only low computational complexity.

Fields of Application for the Inventive Processing

The concept of object-specific t/f-representations and its associated signaling to the decoder can be applied on any SAOC-scheme. It can be combined with any current and also future audio formats. The concept allows for enhanced perceptual audio object estimation in SAOC applications by an audio object adaptive choice of an individual t/f-resolution for the parametric estimation of audio objects.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, for example, a microprocessor, a programmable computer, or an electronic circuit. In some embodiments, some single or multiple method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example, a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transmitting.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. An audio decoder device for decoding a multi-object audio signal comprising a downmix signal and side information, the side information comprising object-specific side information for at least one audio object in at least one time/frequency region, and object-specific time/frequency resolution information indicative of an object-specific time/frequency resolution of the object-specific side information for the at least one audio object in the at least one time/frequency region, the audio decoder device comprising:

an object-specific time/frequency resolution determiner configured to determine the object-specific time/frequency resolution information from the side information for the at least one audio object;

an object separator configured to separate the at least one audio object from the downmix signal using the object-specific side information in accordance with the object-specific time/frequency resolution; and wherein the object separator is configured to determine an estimated covariance matrix with elements $e_{i,j}^{\eta,\kappa}$ of the at least one audio object and at least one further audio object according to $$e_{i,j}^{\eta,\kappa}=\sqrt{fsl_i^{\eta,\kappa}fsl_j^{\eta,\kappa}}fsc_{i,j}^{\eta,\kappa}$$

wherein $e_{i,j}^{\eta,\kappa}$ is the estimated covariance of audio objects i and j for fine-structure time-slot η and fine-structure (hybrid) sub-band κ;

$fsl_i^{\eta,\kappa}$ and $fsl_j^{\eta,\kappa}$ are the object-specific side information of the audio objects i and j for fine-structure time-slot η and fine-structure (hybrid) sub-band κ;

$fsc_{i,j}^{\eta,\kappa}$ is an inter object correlation information of the audio objects i and j, respectively, fine-structure time-slot η and fine-structure (hybrid) sub-band κ;

wherein at least one of $fsl_i^{\eta,\kappa}$, $fsl_j^{\eta,\kappa}$, and $fsc_{i,j}^{\eta,\kappa}$ varies within the time/frequency region according to the object-specific time/frequency resolution for the audio objects i and j indicated by the object-specific time/frequency resolution information, and wherein the object separator is further configured to separate the at least one audio object from the downmix signal using the estimated covariance matrix.

2. The audio decoder device according to claim 1, wherein the object-specific side information is a fine structure object-specific side information for the at least one audio object in the at least one time/frequency region, and wherein the side information further comprises coarse object-specific side information for the at least one audio object in the at least one time/frequency region, the coarse object-specific side information being constant within the at least one time/frequency region.

3. The audio decoder device according to claim 1, wherein the fine structure object-specific side information describes a difference between the coarse object-specific side information and the at least one audio object.

4. The audio decoder device according to claim 1, wherein the downmix signal is sampled in the time/frequency domain into a plurality of time-slots and a plurality of sub-bands, wherein the time/frequency region extends over at least two samples of the downmix signal, and wherein the object-specific time/frequency resolution is finer in at least one of both dimensions than the time/frequency region.

5. The audio decoder device according to claim 1, further comprising:

a downmix signal time/frequency transformer configured to transform the downmix signal within the time/frequency region from a downmix signal time/frequency resolution to at least the object-specific time/frequency resolution of the at least one audio object to acquire a re-transformed downmix signal;

an inverse time/frequency transformer configured to time/frequency transform the at least one audio object within the time/frequency region from the object-specific time/frequency resolution back to a common t/f-resolution or the downmix signal time/frequency resolution;

wherein the object separator is configured to separate the at least one audio object from the downmix signal at the object-specific time/frequency resolution.

6. An audio encoder device for encoding a plurality of audio objects into a downmix signal and side information, the audio encoder device comprising:

a time-to-frequency transformer configured to transform the plurality of audio objects at least to a first plurality of corresponding transformations using a first time/frequency resolution and to a second plurality of corresponding transformations using a second time/frequency resolution;

a side information determiner configured to determine at least a first side information for the first plurality of corresponding transformations and a second side information for the second plurality of corresponding transformations, the first and second side information indicating a relation of the plurality of audio objects to each other in the first and second time/frequency resolutions, respectively, in a time/frequency region; and a side information selector configured to select, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder device; wherein the suitability criterion is based on a source estimation and wherein the side information selector comprises:

a source estimator configured to estimate at least a selected audio object of the plurality of audio objects using the downmix signal and at least the first side information and the second side information corresponding to the first and second time/frequency resolutions, respectively, the source estimator thus providing at least a first estimated audio object and a second estimated audio object;

a quality assessor configured to assess a quality of at least the first estimated audio object and the second estimated audio object.

7. The audio encoder device according to claim 6, wherein the quality assessor is configured to assess the quality of at least the first estimated audio object and the second estimated audio object on the basis of a signal-to-distortion ratio as a source estimation performance measure, the signal-to-distortion ratio being determined solely on the basis of the side information.

8. The audio encoder device according to claim 6, wherein the side information determiner is further configured to provide fine structure object-specific side information and coarse object-specific side information as a part of at least one of the first side information and the second side information, the coarse object-specific side information being constant within the at least one time/frequency region.

9. The audio encoder device according to claim 8, wherein the fine structure object-specific side information describes a difference between the coarse object-specific side information and the at least one audio object.

10. The audio encoder device according to claim 6, further comprising a downmix signal processor configured to transform the downmix signal to a representation that is sampled in the time/frequency domain into a plurality of time-slots and a plurality of sub-bands, wherein the time/frequency region extends over at least two samples of the downmix signal, and wherein an object-specific time/frequency resolution specified for at least one audio object is finer in at least one of both dimensions than the time/frequency region.

11. An audio encoder device for encoding a plurality of audio objects into a downmix signal and side information, the audio encoder device comprising:

a time-to-frequency transformer configured to transform the plurality of audio objects at least to a first plurality of corresponding transformations using a first time/frequency resolution and to a second plurality of corresponding transformations using a second time/frequency resolution;

a side information determiner configured to determine at least a first side information for the first plurality of corresponding transformations and a second side information for the second plurality of corresponding transformations, the first and second side information indicating a relation of the plurality of audio objects to each other in the first and second time/frequency resolutions, respectively, in a time/frequency region; and a side information selector configured to select, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder device;

wherein the suitability criterion for the at least one audio object among the plurality of audio objects is based on degrees of sparseness of more than one t/f-resolution representations of the at least one audio object according to at least the first time/frequency resolution and the second time/frequency resolution, and wherein the side information selector is configured to select the side information among at least the first and second side information that is associated with the most sparse t/f-representation of the at least one audio object.

12. A method for decoding a multi-object audio signal comprising a downmix signal and side information, the side information comprising object-specific side information for at least one audio object in at least one time/frequency region, and object-specific time/frequency resolution information indicative of an object-specific time/frequency resolution of the object-specific side information for the at least one audio object in the at least one time/frequency region, the method comprising:

determining the object-specific time/frequency resolution information from the side information for the at least one audio object; and separating the at least one audio object from the downmix signal using the object-specific side information in accordance with the object-specific time/frequency resolution; wherein the separating includes:

determining an estimated covariance matrix with elements $e_{i,j}^{\eta,\kappa}$ of the at least one audio object and at least one further audio object according to $$e_{i,j}^{\eta,\kappa}=\sqrt{fsl_i^{\eta,\kappa}fsl_j^{\eta,\kappa}}fsc_{i,j}^{\eta,\kappa}$$

wherein $e_i^{\eta,\kappa}$ is the estimated covariance of audio objects i and j for fine-structure time-slot η and fine-structure (hybrid) sub-band κ;

$fsl_i^{\eta,\kappa}$ and $fsl_j^{\eta,\kappa}$ are the object-specific side information of the audio objects i and j for fine-structure time-slot η and fine-structure (hybrid) sub-band κ;

$fsc_{i,j}^{\eta,\kappa}$ is an inter object correlation information of the audio objects i and j, respectively, fine-structure time-slot η and fine-structure (hybrid) sub-band κ;

wherein at least one of $fsl_i^{\eta,\kappa}$, $fsl_j^{\eta,\kappa}$, and $fsc_{i,j}^{\eta,\kappa}$ varies within the time/frequency region according to the object-specific time/frequency resolution for the audio objects i and j indicated by the object-specific time/frequency resolution information, and wherein the separating further includes, separating the at least one audio object from the downmix signal using the estimated covariance matrix.

13. A method for encoding a plurality of audio object to a downmix signal and side information, the method comprising:

transforming the plurality of audio object at least to a first plurality of corresponding transformations using a first time/frequency resolution and to a second plurality of corresponding transformations using a second time/frequency resolution;

determining at least a first side information for the first plurality of corresponding transformations and a second side information for the second plurality of corresponding transformations, the first and second side information indicating a relation of the plurality of audio object to each other in the first and second time/frequency resolutions, respectively, in a time/frequency region; and selecting, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder device; wherein the suitability criterion is based on a source estimation and wherein selecting comprises:

estimating at least a selected audio object of the plurality of audio objects using the downmix signal and at least the first side information and the second side information corresponding to the first and second time/frequency resolutions, respectively, the estimating thus providing at least a first estimated audio object and a second estimated audio object; assessing a quality of at least the first estimated audio object and the second estimated audio object.

14. A method for encoding a plurality of audio object to a downmix signal and side information, the method comprising:

transforming the plurality of audio object at least to a first plurality of corresponding transformations using a first time/frequency resolution and to a second plurality of corresponding transformations using a second time/frequency resolution;

determining at least a first side information for the first plurality of corresponding transformations and a second side information for the second plurality of corresponding transformations, the first and second side information indicating a relation of the plurality of audio object to each other in the first and second time/frequency resolutions, respectively, in a time/frequency region; and selecting, for at least one audio object of the plurality of audio objects, one object-specific side information from at least the first and second side information on the basis of a suitability criterion indicative of a suitability of at least the first or second time/frequency resolution for representing the audio object in the time/frequency domain, the object-specific side information being inserted into the side information output by the audio encoder device;

wherein the suitability criterion for the at least one audio object among the plurality of audio objects is based on degrees of sparseness of more than one t/f-resolution representations of the at least one audio object according to at least the first time/frequency resolution and the second time/frequency resolution, and wherein the selecting further includes selecting the side information among at least the first and second side information that is associated with the most sparse t/f-representation of the at least one audio object.

* * * * *